US009818342B2

(12) United States Patent
Park

(10) Patent No.: US 9,818,342 B2
(45) Date of Patent: Nov. 14, 2017

(54) DISPLAY DEVICE AND TRANSISTOR STRUCTURE FOR THE SAME

(71) Applicant: LG Display Co., Ltd., Seoul (KR)

(72) Inventor: Joon-Min Park, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/801,354

(22) Filed: Jul. 16, 2015

(65) Prior Publication Data

US 2016/0098960 A1 Apr. 7, 2016

(30) Foreign Application Priority Data

Oct. 6, 2014 (KR) ..... 10-2014-0134069

(51) Int. Cl.
*G09G 3/3233* (2016.01)

(52) U.S. Cl.
CPC ... *G09G 3/3233* (2013.01); *G09G 2300/0465* (2013.01); *G09G 2300/0842* (2013.01); *G09G 2310/0262* (2013.01); *G09G 2320/0295* (2013.01); *G09G 2320/043* (2013.01)

(58) Field of Classification Search
CPC ..... G09G 3/3233; G09G 3/3258; G09G 3/30; G09G 2300/0439; H01L 27/3272; H01L 2924/0002; H01L 2924/00; H01L 29/78633; H01L 51/5284; H01L 23/5225; H01L 27/283; H01L 27/32; H01L 27/3241; H01L 27/3244; H01L 27/3262; H01L 27/3274; H01L 27/3288
See application file for complete search history.

(56) References Cited

U.S. PATENT DOCUMENTS

2009/0256854 A1 10/2009 Mizukoshi et al.
2013/0050292 A1* 2/2013 Mizukoshi ..... G09G 3/3291 345/690
2013/0083001 A1* 4/2013 Jeong ..... G09G 3/3233 345/212
2014/0022289 A1* 1/2014 Lee ..... G09G 3/3283 345/691

(Continued)

FOREIGN PATENT DOCUMENTS

CN 101116129 A 1/2008
CN 102968954 A 3/2013
CN 103077662 A 5/2013

(Continued)

OTHER PUBLICATIONS

European Patent Office, Search Report and Opinion, European Patent Application No. 15173372.2, dated Sep. 22, 2015, twenty-one pages.

(Continued)

*Primary Examiner* — Koosha Sharifi-Tafreshi
(74) *Attorney, Agent, or Firm* — Fenwick & West LLP

(57) ABSTRACT

Disclosed are a transistor structure for a display and an organic light emitting display device. The transistor structure includes: a voltage line positioned in one direction and configured to supply voltage to pixels; and two or more transistors which share one of drains and sources which are formed integrally with the voltage line and respectively include the other of the drains and sources which are individually formed and connected with different nodes directly or through a connection pattern.

18 Claims, 28 Drawing Sheets

(56) References Cited

U.S. PATENT DOCUMENTS

| | | | |
|---|---|---|---|
| 2014/0092076 | A1 | 4/2014 | Lee |
| 2014/0285407 | A1 | 9/2014 | Chaji et al. |

FOREIGN PATENT DOCUMENTS

| | | | |
|---|---|---|---|
| CN | 103578411 | A | 2/2014 |
| CN | 103714777 | A | 4/2014 |
| EP | 2 874 141 | A1 | 5/2015 |
| EP | 2 889 861 | A1 | 7/2015 |

OTHER PUBLICATIONS

Chinese First Office Action, Chinese Application No. 201510459683.1, Aug. 21, 2017, 18 pages.

* cited by examiner

DISPLAY DEVICE AND TRANSISTOR STRUCTURE FOR THE SAME

CROSS-REFERENCE TO RELATED APPLICATION

This application claims priority from and the benefit under 35 U.S.C. §119(a) of Korean Patent Application No. 10-2014-0134069, filed on Oct. 6, 2014, which is hereby incorporated by reference for all purposes as if fully set forth herein.

BACKGROUND OF THE INVENTION

1. Field of the Invention

The present invention relates to an organic light emitting display device that displays an image.

2. Description of the Prior Art

Recently, an organic light emitting display device, spotlighted as a display device, uses self-luminous Organic Light Emitting Diodes (OLED) and thus, is advantageous in that it has a fast response speed, high light emitting efficiency, high luminance, and a wide viewing angle.

The organic light emitting display device includes pixels, which are provided with organic light emitting diodes and arranged in a matrix form, and controls brightness of the pixels selected by a scan signal according to a gradation of data.

Each pixel of the organic light emitting display device includes, for example, a data line and a gate line, which intersect with each other, a transistor and a storage capacitor which have a connection structure with the data line and the gate line, in addition to an organic light emitting diode.

In order to execute various functions, each pixel may further include transistors suitable for the functions. Due to this, it is inevitable that a number of signal lines for supplying various signals to the transistors increases and pixel structures become more complicated. For example, when an inner or outer compensation circuit for compensating for non-uniformity of luminance among the pixels is applied to a pixel structure, a transistor involved in a sensing operation for compensation should be added which causes the number of required signal lines to increase and the pixel structure to be complicated.

As demand for a large area or high resolution increases, it is inevitable that the number of signal lines increases accordingly, and in practice, the pixel structures become further complicated.

As described above, due to, for example, the addition of various functions such as a sensing function and a compensation function, and increase of demand for a large area or high resolution, the number of signal lines increase, and as a result, it is inevitable that the number of IC pads and the number of ICs increase accordingly and the pixel structures become further complicated.

This may make manufacturing difficult, increase the incidence probability of pixel defects, remarkably degrade a numerical aperture, and considerably shorten the lifespan of the organic light emitting diodes. Consequently, it becomes difficult or impossible to obtain a high quality display panel, thereby reducing yield.

SUMMARY OF THE INVENTION

In consideration of the problems described above, an object of the present invention is to provide a display panel having a simple and compact structure and an organic light emitting display device including the display panel.

Another object of the present invention is to provide a display panel having a pixel structure capable of at least one (e.g., all) of increasing a numerical aperture, lengthening the lifespan of a light emitting diode, and reducing the incident probability of defects, and an organic light emitting display device including the display panel.

Still another object of the present invention is to provide an organic light emitting display device having sensing and compensation functions suitable for a simple and compact pixel structure in providing efficient sensing and compensation functions for compensating for a luminance deviation among pixels.

In order to achieve one or more (e.g., all) of the above-described objects, in one aspect, the present invention provides an organic light emitting display device comprising: a plurality of data lines positioned in one direction; a plurality of gate lines positioned in another direction intersecting with the plurality of data lines; a plurality of pixels connected with the plurality of data lines and the plurality of gate lines; and a reference voltage line positioned in the one direction and configured to supply a reference voltage to the pixels, wherein each of the plurality of pixels includes: an organic light emitting diode, a driving transistor configured to drive the organic light emitting diode, a first transistor controlled by a first scan signal from the gate lines and connected between the reference voltage line and a first node of the driving transistor, and a second transistor controlled by a second scan signal supplied from the gate lines and connected between the data lines and a second node of the driving transistor, wherein each first transistor has a first source/drain node and a second source/drain node, wherein the first source/drain nodes of the first transistors of two or more pixels are configured as a shared node formed integrally with the reference voltage line, and the second source/drain nodes of the first transistors of said two or more pixels are configured as respective nodes separate from each other, and each of said respective nodes is connected with the first node of the driving transistor of a respective pixel directly or through a connection pattern.

The first source/drain nodes may be source nodes and the second source/drain nodes may be drain nodes of the respective first transistors. Alternatively, the first source/drain nodes may be drain nodes and the second source/drain nodes may be source nodes of the respective first transistors.

In one or more embodiments, the reference voltage line is positioned in the one direction to supply the reference voltage to a pixel connected with a $(4n-3)^{th}$ data line, a pixel connected with a $(4n-2)^{th}$ data line, a pixel connected with a $(4n-1)^{th}$ data line, and a pixel connected with a $(4n)^{th}$ data line (n being a natural number), and the first source/drain nodes of four first transistors of the pixel connected with the $(4n-3)^{th}$ data line, the pixel connected with the $(4n-2)^{th}$ data line, the pixel connected with the $(4n-1)^{th}$ data line, and the pixel connected with the $(4n)^{th}$ data line, respectively, are configured as said shared node formed integrally with the reference voltage line, and the second source/drain nodes of said four first transistors are individually configured as said respective nodes (in other words, are configured as individual nodes).

In one or more embodiments, each of the respective nodes of the first transistors, which are respectively included in the pixel connected with the (4n−2)th data line and the pixel connected with the (4n−1)th data line, is connected with the first node of the driving transistor directly, and each of the respective nodes, which are respectively included in the pixel connected with the (4n−3)th data line and the pixel connected with the (4n)th data line, is connected with the first node of the driving transistor through the connection pattern.

In one or more embodiments, the shared node has a shape obtained by combining two or more of a "|" shape, a "—" shape, a "¬" shape, a "L" shape, a "⊏" shape, and partially rounded shapes thereof.

In one or more embodiments, the shared node has a "+" shape, a "⊥" shape, a "E" shape, or a "⊢⊣" shape.

In one or more embodiments, a distance between the shared node and the respective node of at least one of the four first transistors is different from that of another one of the four first transistors.

In one or more embodiments, a pixel structure of the pixel connected with the (4n−3)th data line and a pixel structure of the pixel connected with the (4n)th data line are symmetric to each other, and a pixel structure of the pixel connected with the (4n−2)th data line and a pixel structure of the pixel connected with the (4n−1)th data line are symmetric to each other.

In one or more embodiments, the organic light emitting display device further comprises: a data driver configured to drive the plurality of data lines positioned in the one direction; a gate driver configured to supply a first scan signal and a second scan signal the plurality of gate lines which are positioned in the other direction intersecting with the data lines; and a timing controller configured to control a driving timing of the data driver and the gate driver.

In one or more embodiments, the organic light emitting display device further comprises: a sensor configured to sense a voltage of the first node of the driving transistor.

In one or more embodiments, the sensor comprises: an analog to digital converter configured to convert the sensed voltage into a digital value; and a first switch configured to perform switching such that one of a reference voltage supply node, to which a reference voltage is supplied, and a sensing node connected to the analog to digital converter is connected with the reference voltage line.

In one or more embodiments, a plurality of sensors are provided, a number of the sensors corresponding to a number of the data lines or a number of reference voltage lines.

In one or more embodiments, the timing controller controls switching operations of: a first switch configured to perform switching between an ON position, in which the reference voltage line is connected with a reference voltage supply node, and an OFF position, in which the reference voltage line is connected with a sensing node, and a second switch configured to perform switching between an ON position, in which a data voltage output point of the data driver is connected with a corresponding data line, and an OFF position, in which the data line is disconnected from the voltage output point and floating.

In one or more embodiments, the organic light emitting display device further comprises: a compensator configured to perform data conversion processing that compensates characteristic information of the driving transistor based on the sensed voltage; and a memory configured to store the sensed voltage or the characteristic information of the driving transistor.

In one or more embodiments, the compensator is included within the timing controller, within the data driver, or outside of the timing controller and the data driver.

In one or more embodiments, when the compensator is included within the timing controller, the compensator converts data supplied from outside into compensation data based on the characteristic information of the driving transistor, and supplies the compensation data to the data driver, when the compensator is included within the data driver, the compensator converts data supplied from the timing controller into the compensation data based on the characteristic information of the driving transistor, before or after converting the data supplied from the timing controller into analog data, and when the compensator is included outside of the timing controller and the data driver, the compensator converts the data supplied from the timing controller into the compensation data based on the characteristic information of the driving transistor and supplies the compensation data to the data driver.

In another aspect, the present invention provides an organic light emitting display device including: a plurality of data lines positioned in one direction; a plurality of gate lines positioned in another direction intersecting with the plurality of data lines; and a plurality of pixels connected with the plurality of data lines and the plurality of gate lines.

In another aspect, the present invention provides a display panel including: a data driver configured to drive a plurality of data lines positioned in one direction; a gate driver configured to supply a first scan signal and a second scan signal through a plurality of gate lines which are positioned in another direction intersecting with the data lines; a timing controller configured to control a driving timing of the data driver and the gate driver; and a plurality of pixels connected with the data lines and the gate lines.

At this time, each of the plurality of pixels includes: an organic light emitting diode, a driving transistor configured to drive the organic light emitting diode, a first transistor controlled by a first scan signal from the gate lines and connected between a reference voltage line and a first node of the driving transistor, and a second transistor controlled by the second scan signal supplied from the gate lines and connected between the data lines and a second node of the driving transistor.

In addition, the reference voltage line is positioned in the one direction to supply a reference voltage to a pixel connected with a $(4n-3)^{th}$ data line, a pixel connected with a $(4n-2)^{th}$ data line, a pixel connected with a $(4n-1)^{th}$ data line, and a pixel connected with a $(4n)^{th}$ data line, wherein n is a natural number. Four first transistors of the pixel connected with the $(4n-3)^{th}$ data line, the pixel connected with the $(4n-2)^{th}$ data line, the pixel connected with the $(4n-1)^{th}$ data line, and the pixel connected with the $(4n)^{th}$ data line may share a node of one of drains and sources configured integrally with the reference voltage line (hereinafter, referred to as a "shared node"), and nodes of the other of the drains and sources (hereinafter, referred to as "respective nodes") are individually configured and each of the respective nodes may be connected with the first node of the driving transistor directly or through a connection pattern.

In still another aspect, the present invention provides a transistor structure for a display device. The transistor structure includes: a voltage line positioned in one direction and configured to supply voltage to pixels; and two or more transistors which share one of drains and sources which are formed integrally with the voltage line and respectively include the other of the drains and sources which are individually formed and connected with different nodes directly or through a connection pattern.

As described above, according to the present invention, it is possible to provide a display panel having a simple and compact structure and an organic light emitting display device including the display panel.

In addition, according to the present invention, it is possible to provide a display panel having a pixel structure capable of at least one (e.g., all) of increasing a numerical aperture, lengthening the lifespan of a light emitting diode, and reducing the incident probability of defects, and an organic light emitting display device including the display panel.

Further, according to the present invention, it is possible to provide an organic light emitting display device having sensing and compensation functions suitable for a simple and compact pixel structure in providing efficient sensing and compensation functions for compensating for a luminance deviation among pixels.

Due to the features described above, a high quality display panel may be manufactured with a high yield.

The features described above may be advantageous when applied to a display panel having a high resolution and a large area.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Figure 1:
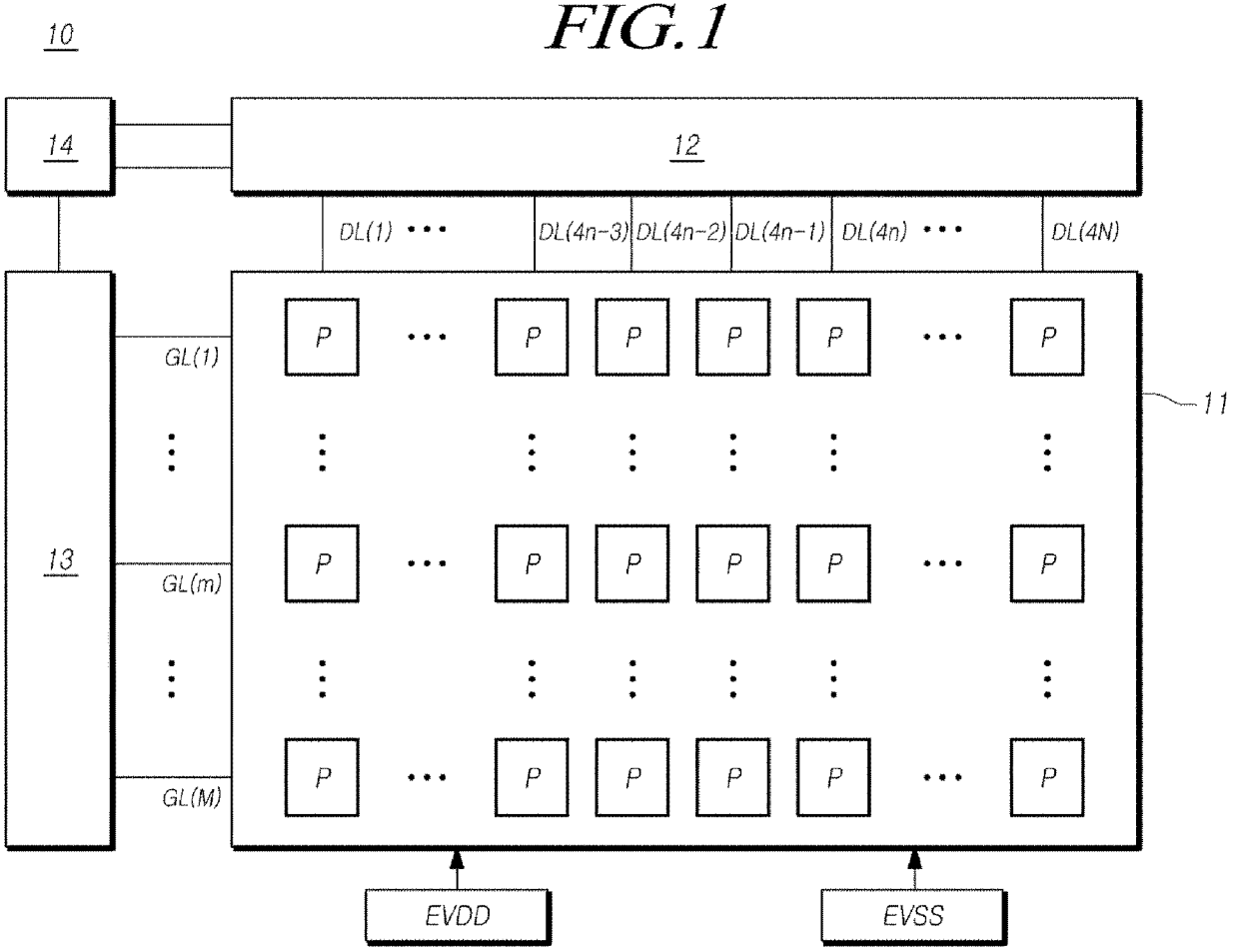
FIG. 1 is a diagram illustrating a configuration of an entire system for an organic light emitting display device according to embodiments of the present invention.

Hereinafter, some of the embodiments of the present invention will be described in detail with reference to exemplary drawings. In the following description, the same elements will be designated by the same reference numerals although they are shown in different drawings. Further, in the following description of the present invention, a detailed description of known functions and configurations incorporated herein will be omitted when it may make the subject matter of the present invention rather unclear.

In addition, terms, such as first, second, A, B, (a), (b) or the like may be used herein when describing components of the present invention. Each of these terminologies is not used to define an essence, order or sequence of a corresponding component but used merely to distinguish the corresponding component from other component(s). In the case that it is described that a certain structural element "is connected to", "is coupled to", or "is in contact with" another structural element, it should be interpreted that another structural element may "be connected to", "be coupled to", or "be in contact with" the structural elements as well as that the certain structural element is directly connected to or is in direct contact with another structural element.

FIG. 1 is a diagram illustrating a configuration of an entire system for an organic light emitting display device 10 according to embodiments of the present invention.

Referring to FIG. 1, according to one embodiment of the present invention, an organic light emitting display device 10 includes: a display panel 11 including a plurality of data lines DL positioned in one direction, a plurality of gate lines GL positioned in another direction intersecting with the plurality of data lines, a plurality of pixels P disposed in intersection regions, respectively; a data driver 12 configured to supply a data voltage through the data lines; a gate driver 13 configured to supply a scan signal through the gate lines; and a timing controller 14 configured to control driving timing of the data driver 12 and the gate driver 13, for example.

Referring to FIG. 1, in the display panel 11, a plurality of data lines DL(1) to DL(4N) are positioned in one direction, and a plurality of gate lines GL(1) to GL(M) are positioned in another direction intersecting with the data lines DL(1) to DL(4N). Here, for the convenience of description, it is assumed that the number of data lines positioned in the display panel 11 is 4N and the number of gate lines is M. Here, N and M are natural numbers of 1 or more. In addition, "n" used for identifying respective data lines in the whole of 4N data lines is a natural number which is 1 or more and ¼ or less of the number of data lines ($1 \leq n \leq (4N/4)$).

In the display panel 11, pixels P are defined in the regions, where 4N data lines DL(1) to DL(4N) and M gate lines GL(1) to GL(M) intersect with each other. A pixel structure of each pixel P will be described in more detail with reference to FIG. 2A.

Figure 2A:
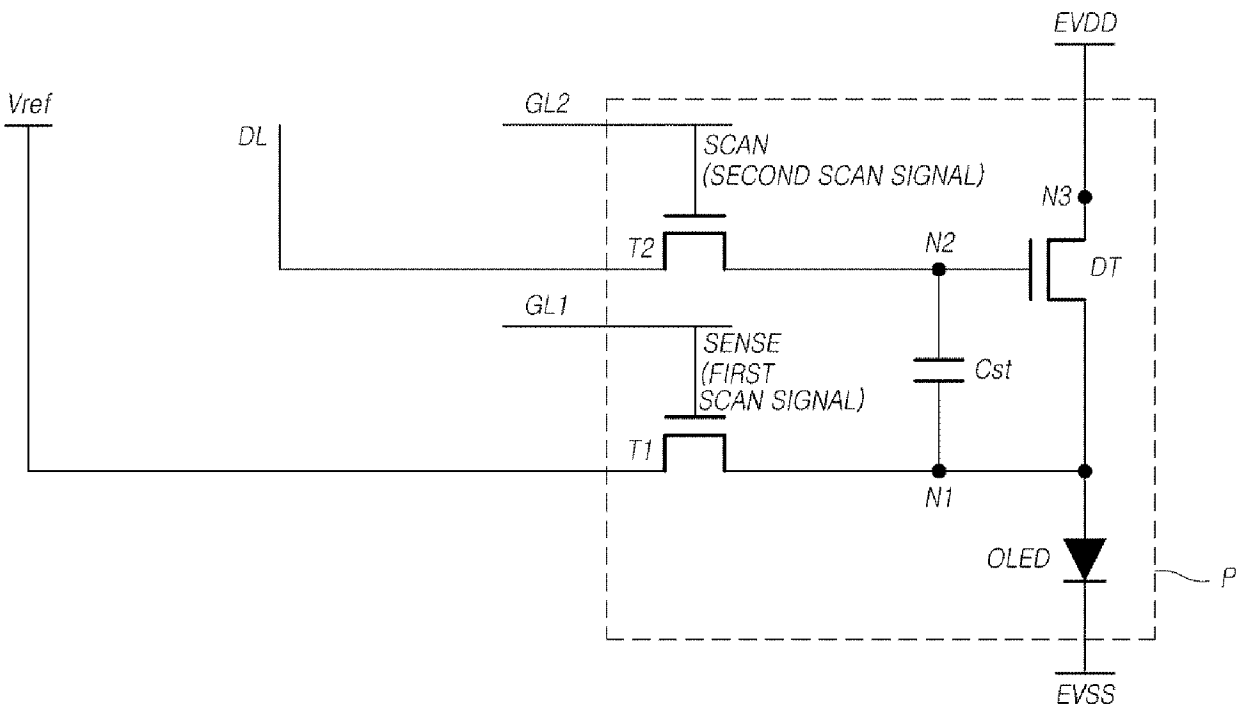
FIG. 2A is an equivalent circuit diagram for one pixel within a display panel of an organic light emitting display device according to one embodiment of the present invention.
Figure 2B:
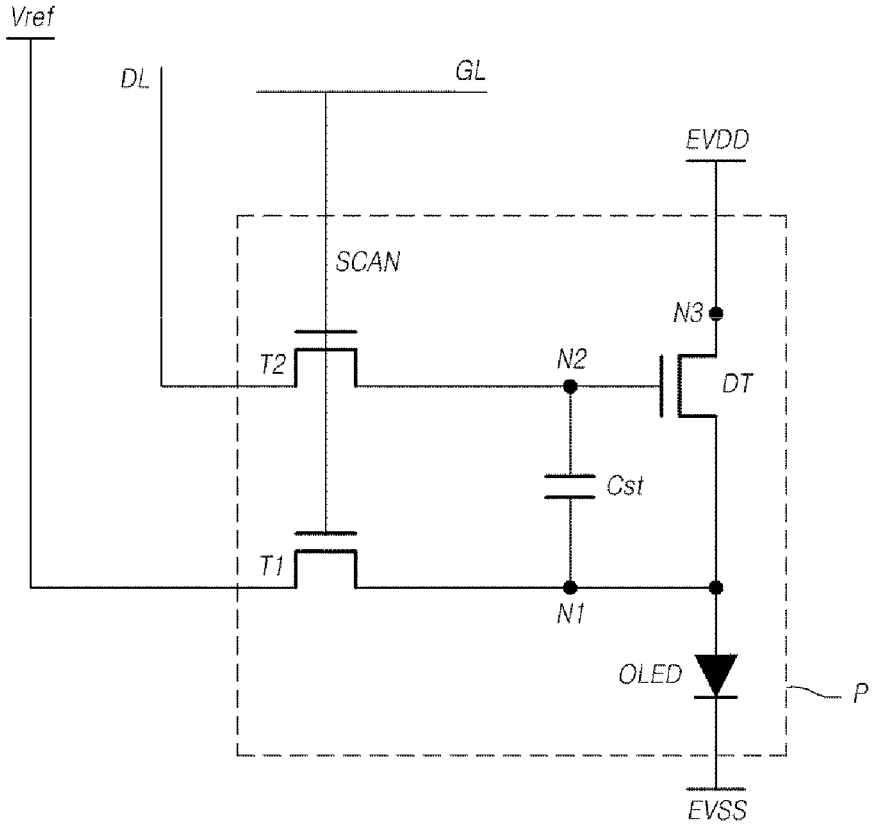
FIG. 2B is an equivalent circuit diagram for one pixel within a display panel of an organic light emitting display device according to another embodiment of the present invention.

FIG. 2A is an equivalent circuit diagram for one pixel within a display panel 11 of an organic light emitting display device 10 according to one embodiment of the present invention. FIG. 2B is an equivalent circuit diagram for one pixel within a display panel of an organic light emitting display device according to another embodiment of the present invention.

Referring to FIG. 2A, according to one embodiment of the present invention, one pixel P within a display panel 11 of the organic light emitting display device 10 has a 3T1C structure basically including three transistors DT, T1, and T2 and one capacitor Cst.

That is, each pixel P includes, for example, an organic light emitting diode OLED, a driving transistor DT configured to drive the organic light emitting diode OLED, a first transistor T1 controlled by a first scan signal supplied from a first gate line GL1 and connected between a connection pattern CP connected to a reference voltage line RVL or a reference voltage line RVL and a first node N1 of the driving transistor DT, a second transistor T2 controlled by a second scan signal supplied from a second gate line GL2 and connected between the data line DL and a second node N2 of the driving transistor DT, and a storage capacitor Cst connected between the first node N1 and the second node N2 of the driving transistor DT.

As described above, each pixel P receives two scan signals (first scan signal and second scan signal) through two gate lines (first gate line and second gate line). Hereinafter, the first scan signal may also be referred to as a "sense signal SENSE", and the second scan signal may also be referred to as a "scan signal SCAN".

Since two scan signals SCAN and SENSE are supplied to each pixel P, the basic pixel structure of one embodiment of the present invention is referred to as a "2-scan structure".

The driving transistor DT in each pixel P is a transistor, to which a driving voltage EVDD supplied from the driving voltage line DVL is applied, and which is controlled by the voltage (data voltage) of the gate node (N2) applied through the second transistor T2 so as to drive the organic light emitting diode OLED.

The driving transistor DT includes a first node N1, a second node N2, and a third node N3, in which the first node N1 is connected with the first transistor T1, the second node N2 is connected with the second transistor T2, and the third node N3 is supplied with the driving voltage EVDD.

Here, as an example, the first node N1 of the driving transistor DT may be a source node (also referred to as a "source electrode"), the second node N2 may be a gate node (also referred to as a "gate electrode"), and the third node N3 may be a drain node (also referred to as a "drain electrode"). Depending on a method of implementing a circuit, the first node, the second node, and the third node of the driving transistor DT may be changed.

In addition, the first transistor T1 is controlled by the first scan signal SENSE supplied from the first gate line GL1, and is connected between the reference voltage line (RVL) that supplies the reference voltage Vref and the first node N1 of the driving transistor DT. The first transistor T1 is also referred to as a "sensor transistor" or "sense transistor".

In addition, the second transistor T2 is controlled by the second scan signal SCAN commonly supplied from the second gate line GL2 and is connected between the corresponding data line DL and the second node N2 of the driving transistor DT. The second transistor T2 is also referred to as a "switching transistor".

In addition, the storage capacitor Cst is connected between the first node N1 and the second node N2 of the driving transistor DT to maintain the data voltage for one frame.

Meanwhile, according to one embodiment of the present invention, the pixel structure of the organic light emitting display device 10 also includes a "signal line connection structure" connected with various signal lines, such as a data line DL to supply a data voltage to each pixel P, a first gate line GL1 to supply a first scan signal SENSE to each pixel P, a second gate line GL2 to supply a second scan signal SCAN to each pixel P, a driving voltage line DVL to supply a driving voltage EVDD to each pixel, and a reference voltage line RVL to supply a reference voltage Vref to each pixel, in addition to the "basic pixel structure (3T1C-based 2-scan structure)".

Here, various signal lines further include, for example, the reference voltage line RVL to supply the reference voltage Vref to each pixel, and the driving voltage line DVL to supply the driving voltage EVDD to each pixel, in addition to the data line to supply the data voltage to each pixel, the first gate line to supply the first scan signal to each pixel, and the second gate line to supply the second scan signal to each pixel.

It has been described that the pixel structure of the organic light emitting display device 10 according to one embodiment of the present invention illustrated in FIG. 2A is a 3T1C-based 2-scan structure including the first gate line GL1 to supply the first scan signal SENSE and the second gate line GL2 to supply the second scan signal SCAN. Without being limited thereto, however, the pixel structure of the organic electroluminescent display device 10 may be a 3T1C-based 1-scan structure including one gate line GL to commonly supply the first scan signal SENSE and the second scan signal SCAN as illustrated in FIG. 2B. The above-mentioned reference voltage lines RVL and driving voltage lines DVL are positioned to be parallel with the data lines DL, and each of the number of reference voltage lines RVL and the number of driving voltage lines DVL may be equal to the number of data lines or smaller than the number of data lines.

When the number of reference voltage lines and the number of driving voltage lines are equal to the number of data lines, each pixel may not only be connected with one data line DL and one gate line GL, but also be directly connected with one driving voltage line DVL and one reference voltage line RVL.

In this case, all the signal line connection structures of respective pixels are equal to each other. That is, a basic unit of the signal line connection structure becomes one pixel so that there may be regularity of signal line connection structures per every one pixel (one pixel column).

When the number of reference voltage lines and the number of driving voltage lines are less than the number of data lines, some pixels may be directly connected with the driving voltage lines DVL and the reference voltage lines RVL, while other pixels may be connected with the driving voltage lines DVL and the reference voltage lines RVL, respectively, through a connection pattern CP without being directly connected with the driving voltage lines DVL and the reference voltage lines RVL.

In this case, all the signal line connection structures of respective pixels may not be equal to each other. However, even if not all of the connection structures of respective pixels to the signal lines are equal to each other, the connection structures of pixels to signal lines may be equal per every few pixels. That is, the unit of signal line connection structures may be some pixels rather than one pixel P, and the regularity of signal line connection structures may repeatedly appear per every few pixels (few pixel columns).

For example, the signal line connection structures may be equally repeated per every four pixels (P1, P2, P3, and P4). That is, the regularity of signal line connection structures may repeatedly appear per every four pixels (four pixel columns), in which case, the basic unit of the signal line connection structures may be four pixels (four pixel columns).

When the basic unit of signal line connection structures is four pixels (four pixel columns), the number of reference voltage lines may be ¼ of the number of data lines. That is, when the number of data lines is 4N, the number of reference voltage lines may be N.

In addition, in the specification and drawings, four pixels P1, P2, P3, and P4 may be, for example, an R (Red) pixel, a G (Green) pixel, a B (Blue) pixel, and a W (White) pixel.

In the specification and drawings, the transistors DT, T1, and T2 are illustrated and described as an N-type merely for the convenience of description. However, according to a design change of a circuit, all the transistors DT, T1, and T2 may be changed to a P-type, or some of the transistors DT, T1, and T2 may be implemented as the N-type and the others may be implemented as the P-type. In addition, the organic light emitting diodes OLED may be changed into an inverted type.

In addition, the transistors DT, T1, and T2 described herein are also referred to as Thin Film Transistors (TFTs).

Hereinafter, the pixel structures including a basic pixel structure (3T1C-based 2-scan structure) and a signal line connection structure as briefly described above will be described in more detail with reference to FIGS. 3A and 4A. However, FIGS. 3A and 4A illustrate a case where the basic unit of signal line connection structures is four pixels.

As described above, when the basic unit of signal line connection structures is four pixels P1 to P4 connected to the data lines DL(4*n*−3), DL(4*n*−2), DL(4*n*−1), and DL(4*n*), one reference voltage line RVL to supply the reference voltage Vref and two driving voltage lines DVL to supply the driving voltage EVDD may exist with respect to the four pixels P1 to P4.

Figure 3A:
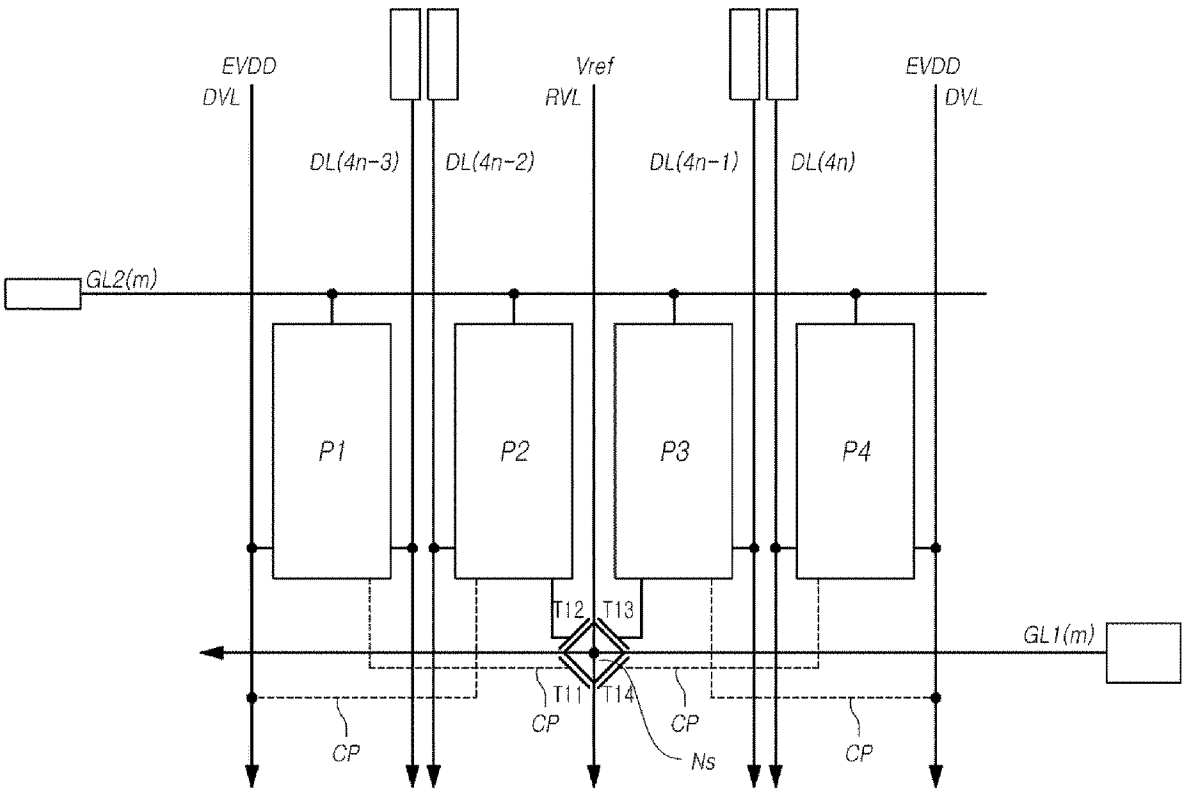
FIG. 3A is a plan view briefly illustrating a part of a display panel of an organic light emitting display device according to one embodiment of the present invention.
Figure 4A:
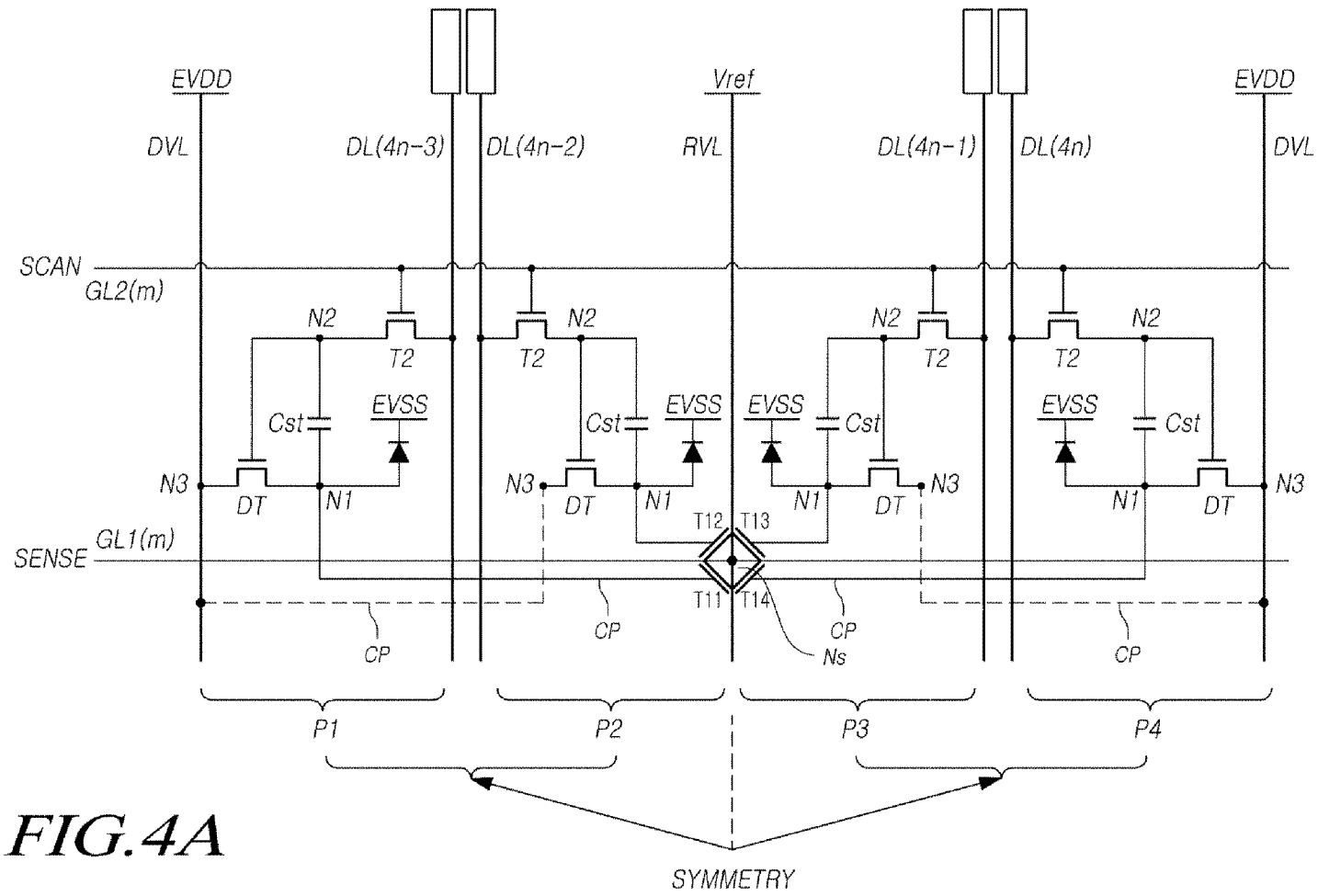
FIG. 4A is an equivalent circuit diagram, in which the equivalent circuit diagram for one pixel illustrated in FIG. 2A is applied to four pixels.

FIG. 3A is a plan view briefly illustrating a part of a display panel 11 of an organic light emitting display device 10 according to one embodiment of the present invention, and FIG. 4A is an equivalent circuit diagram, in which the equivalent circuit diagram for one pixel illustrated in FIG. 2A is applied to four pixels.

Referring to FIGS. 3A and 4A, a signal connection structure and a basic pixel structure (3T1C-based 2-scan structure) may be confirmed with respect to a case where the basic unit of signal line connection structures is four pixels P1 to P4 that require four data lines DL(4*n*−3), DL(4*n*−2), DL(4*n*−1), and DL(4*n*).

Referring to FIGS. 3A and 4A, the four data lines DL(4*n*−3), DL(4*n*−2), DL(4*n*−1), and DL(4*n*) are connected to four pixels P1, P2, P3, and P4, respectively. Each of a first gate line GL1(*m*)(1≤m≤M) and a second gate line GL2(*m*)(1≤m≤M) is connected with the four pixels P1, P2, P3, and P4.

In addition, as illustrated in FIG. 3A, each of the four pixels P1 to P4, which are respectively connected with the four data lines DL(4*n*−3), DL(4*n*−2), DL(4*n*−1), and DL(4*n*) equally includes a driving transistor DT, which receives a driving voltage EVDD to control an organic light emitting diode, a first transistor T1 (e.g., pixel P1 includes first transistor T11, pixel P2 includes first transistor T12, pixel P3 includes first transistor T13, and pixel P4 includes first transistor T14), which is controlled by a first scan signal SENSE and receives a reference voltage Vref and transmits the reference voltage Vref to a first node N1 of the driving transistor DT, a second transistor T2 which is controlled by a second scan signal SCAN and receives a data voltage Vdata and transmits the data voltage Vdata to a second node N2 of the driving transistor DT, and a capacitor Cst connected between the first node N1 and the second node N2 of the driving transistor DT.

Four (first) transistors T11, T12, T13, and T14 of the pixel P1 connected with the $(4n-3)^{th}$ data line DL(4*n*−3), the pixel P2 connected with the $(4n-2)^{th}$ data line DL(4*n*−2), the pixel P3 connected with the $(4n-1)^{th}$ data line DL(4*n*−1), and the pixel P4 connected with the $(4n)^{th}$ data line DL(4*n*) share a node Ns of one of drains and sources configured integrally with the reference voltage line, nodes N11, N12, N13, and N14 of the other of respective drains or sources are individually configured, and each of the nodes N11, N12, N13, and N14 is connected with a first node N1 of the driving transistor DT of the respective pixel directly or through a connection pattern. In other words, first source/drain nodes (e.g., source nodes or drain nodes) of the four first transistors T11, T12, T13, T14 may be configured as the shared node Ns formed integrally with the reference voltage line RVL while second source/drain nodes (e.g., drain nodes or source nodes) of the four first transistors T11, T12, T13, T14 may be configured as individual nodes (also referred to as "respective nodes") N11, N11, N13, N14. See, e.g., FIGS. 6A, 6B, 6E-6G for further illustrations of individual nodes N11, N12, N13, N14 and shared node Ns.

The sources and drains of the first transistors T11, T12, T13, and T14 may be oppositely operated depending on a semiconductor type (e.g., P-type or N-type). In addition, the sources and drains within the first transistors T11, T12, T13, and T14 may be operated in a different manner depending on the operation. Accordingly, one node among the drains or sources configured integrally with the reference voltage line in the first transistors T11, T12, T13, and T14 is referred to as a shared node Ns, the other nodes which are individually configured and each connected with the first node N1 of the driving transistor DT directly or through the connection pattern are referred to as respective nodes N11, N12, N13, and N14.

A semiconductor layer or an active layer ACT is positioned between the shared node Ns and four respective nodes N11, N12, N13, and N14.

The respective nodes N12 and N13 of the first transistors T12 and T13, which are respectively included in the pixel P2 connected with the $(4n-2)^{th}$ data line DL(4*n*−2) and the pixel P3 connected with the $(4n-1)^{th}$ data line DL(4*n*−1), are directly connected with the first node N1 of the driving transistor DT. In addition, the respective nodes N11 and N14 of the first transistors T11 and T14 which are respectively included in the pixel P1connected with the $(4n-3)^{th}$ data line DL(4*n*−3) and the pixel P4 connected with the $(4n)^{th}$ data line DL(4*n*) are connected with the first node N1 of the driving transistor through the connection pattern CP.

In this manner, each of the four pixels P1 to P4 connected with four data lines DL(4*n*−3), DL(4*n*−2), DL(4*n*−1), and DL(4*n*) has a configuration in which each of the first transistor T1 and the second transistor T2 is supplied with the first scan signal and the second scan signal, respectively. As described above, the pixel structure of each pixel described above is referred to as a "3T1C-based 2-scan structure".

Meanwhile, even if the four pixels P1 to P4connected with the four data lines DL(4*n*−3), DL(4*n*−2), DL(4*n*−1), and DL(4*n*) are equal to each other in terms of, for example, the number of transistors, the number of capacitors, and the number of scan signals, they may be different from each other in terms of the signal line connection structure (signal application method) to receive, for example, the data voltage, the driving voltage, and the reference voltage. However, the signal line connection structures among the four pixels P1 to P4connected with the four data lines DL(4*n*−3), DL(4*n*−2), DL(4*n*−1), and DL(4*n*) have certain regularity and symmetry.

As described above, when the basic unit of signal line connection structures is four pixels P1 to P4that require four data lines DL(4*n*−3), DL(4*n*−2), DL(4*n*−1), and DL(4*n*), one reference voltage line RVL for supplying a reference voltage Vref may exist and two driving voltage lines DVL for supplying a driving voltage EVDD may exist with respect to four pixels P1 to P4.

Since two gate lines GL1(*m*) and GL2(*m*) exist with respect to one pixel row as described above, it is possible to differently control the first transistor T1 and the second transistor T2 included in each of the pixels existing in one pixel row. This is due to the fact that the basic pixel structure of one embodiment of the present invention has the 3T1C-based 2-scan structure.

Figure 3B:
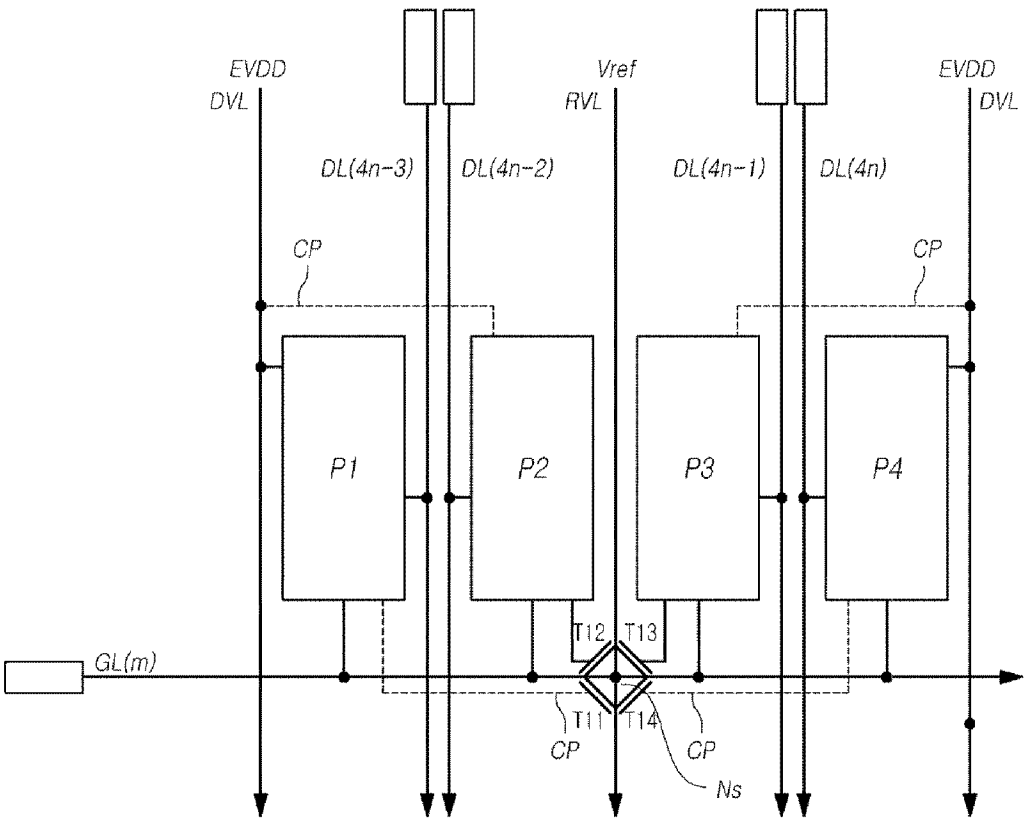
FIG. 3B is a plan view briefly illustrating a part of a display panel of an organic light emitting display device according to another embodiment of the present invention.
Figure 4B:
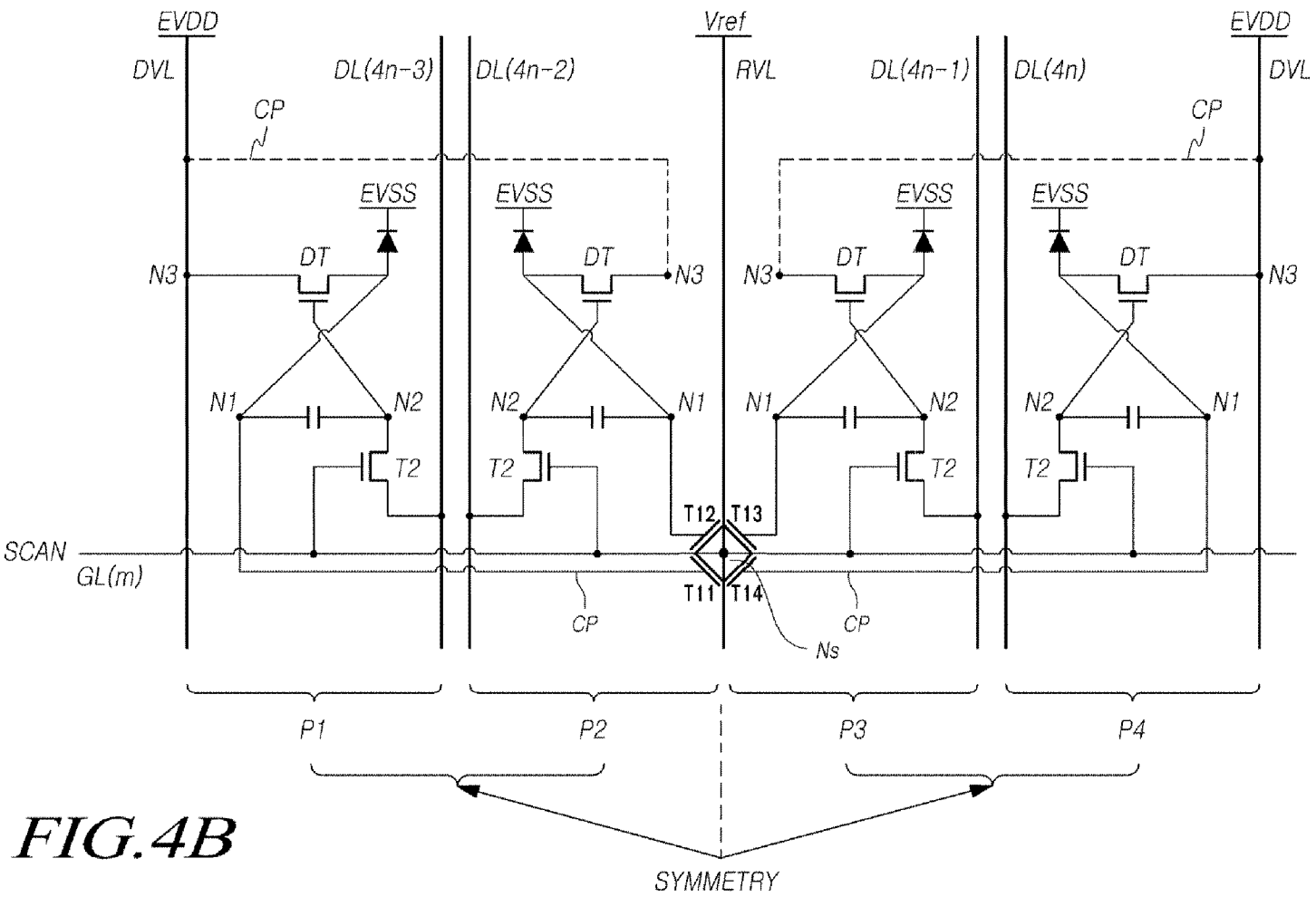
FIG. 4B is an equivalent circuit diagram, in which the equivalent circuit diagram for one pixel illustrated in FIG. 2B is applied to four pixels.

FIG. 3B is a plan view briefly illustrating a part of a display panel of an organic light emitting display device according to another embodiment of the present invention. FIG. 4B is an equivalent circuit diagram, in which the equivalent circuit diagram for one pixel illustrated in FIG. 2B is applied to four pixels.

It has been described that the pixel structure of the organic light emitting display device 10 according to one embodiment of the present invention illustrated in FIGS. 3A and 4A is the 3T1C-based 2-scan structure including the first gate line GL1(*m*) to supply the first scan signal SENSE and the second gate line GL2(*m*) to supply the second scan signal SCAN. Without being limited thereto, however, the pixel structure may be a 3T1C-based 1-scan structure including one gate line GL(m) to commonly supply the first scan signal SENSE and the second scan signal SCAN as illustrated in FIGS. 3B and 4B. Herein, supplying the first scan signal and the second scan signal through two different gate lines GL1(*m*) and GL2(*m*) like the 3T1C-based 2-scan structure or through one common gate line GL(m) like the 3T1C-based 1-scan structure means that the first scan signal and the second scan signal are supplied through a gate line.

As described above, since the display panel 11 has a symmetric structure in the four pixel column P1 to P4 unit (a single symmetric structure), there are advantages in that the panel structure may be made to be simple and compact even with the 3T1C pixel structure that necessarily requires two scan signals SENSE and SCAN, the incidence probability of defects may be reduced accordingly, and the numerical aperture may also be increased. Due to this, it is possible to manufacture a good quality panel with high yield. In particular, it is possible to manufacture a high resolution and large area panel with higher quality and high yield.

Meanwhile, descriptions will be made, with reference to FIG. 7, on an efficient sensing function that enables characteristic information of driving transistors DT included in respective pixels to be determined, a compensation function that determines the characteristic information of the driving transistors DT included in the respective pixels based on the sensed information and compensates for the characteristic information of the driving transistor DT so as to reduce a characteristic deviation among the driving transistors DT in the respective pixels, and a structure that allows the sensing function and the compensation function to be efficiently executed, in the organic light emitting display device 10 according to one embodiment of the present invention.

Figure 5:
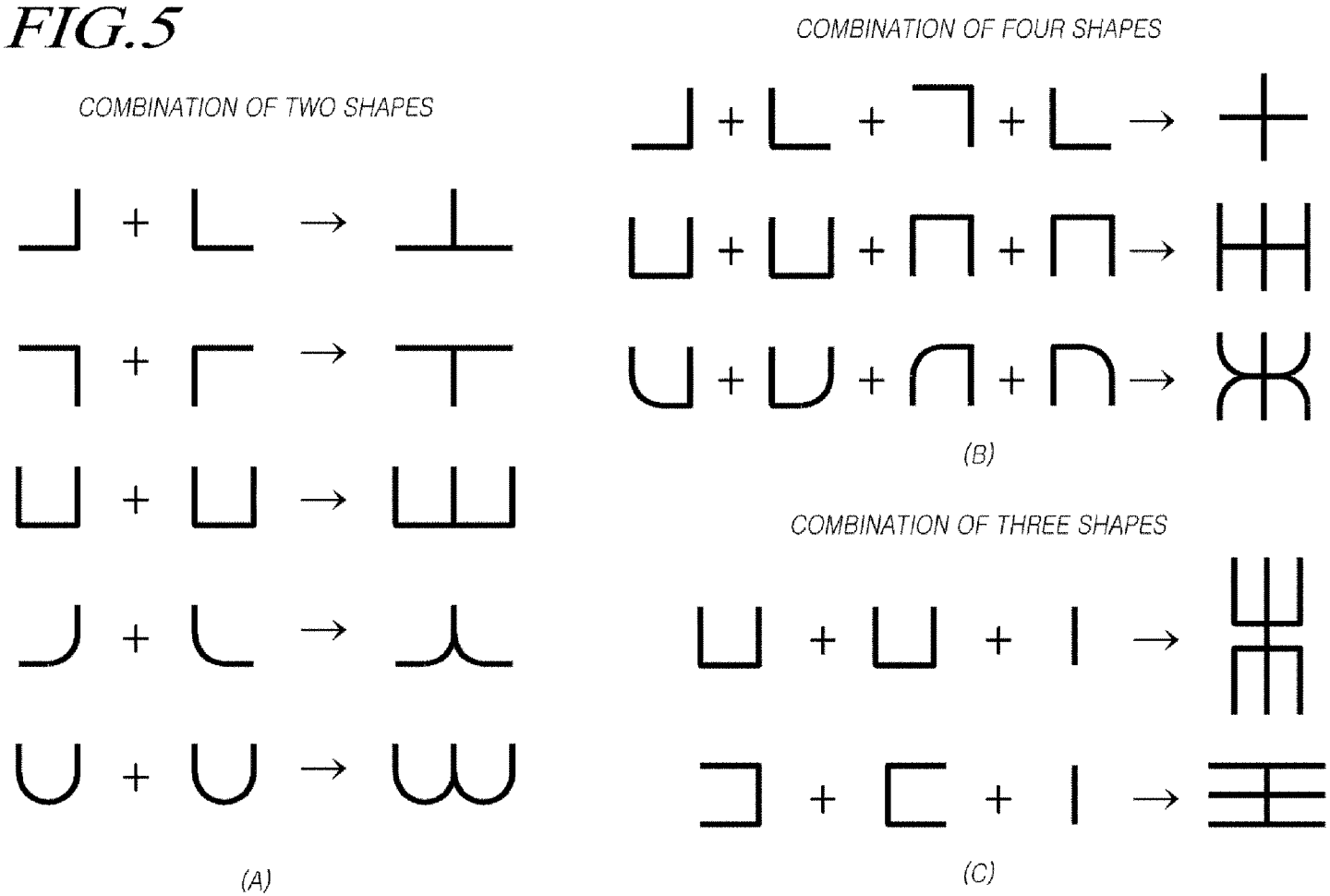
FIG. 5 illustrates various examples that configure a shape of a shared node of first transistors.

FIG. 5 illustrates various examples that constitute the shapes of the shared nodes of the first transistors.

Referring to FIG. 5, the shared node Ns may have, for example, a "|" shape, a "—" shape, a "┐" shape, a "└" shape, a "⊏" shape, or a shape obtained by combining two or more of partially rounded forms of the shapes.

As in FIG. 5(A), the shared node Ns may have a shape obtained by combining two of partially rounded forms of the "|" shape, the "—" shape, the "┐" shape, the "└" shape, and the "⊏" shape. For example, the shared node Ns may have a "⊥" shape obtained by combining two "└" shapes or a "⊤" shape obtained by combining two "┐" shapes. In addition, the shared node Ns may have a "⊥" shape obtained by combining two "└" shapes, in each of which the bent portion is rounded, and a "⊤" shape obtained by combining two "┐" shapes, in each of which the bent portion is rounded.

In addition, as in FIG. 5(B), the shared node Ns may have a shape obtained by combining four of the "|" shape, the "—" shape, the "┐" shape, the "└" shape, the "⊏" shape, and the partially rounded shapes thereof. For example, the shared node Ns may have a "┼" shape obtained by combining two "┐" shapes and two "└" shapes, or a "⊞" shape obtained by combining four "⊏" shapes.

In addition, as in FIG. 5(*c*), the shared node Ns may have a shape obtained by combining three of the "|" shape, the "

—" shape, the "┐" shape, the "└" shape, the "⊏" shape, and the partially rounded shapes thereof. For example, the shared node Ns may have a "⊞" shape obtained by combining two "⊏" shapes and one "|" shape.

It has been described with reference to FIG. 5 that the shared node Ns may have a shape obtained by combining two to four of the "|" shape, the "—" shape, the "┐" shape, the "└" shape, the "⊏" shape, and the partially rounded shapes thereof, by way of an example. Without being limited thereto, however, the shared node Ns may have any shape obtained by combining two or more shapes.

Hereinafter, the first transistors T11, T12, T13, T14 of the first to fourth pixels P1 to P4 in the cases where the shared node Ns has a "┼" shape, a shared node of a "├┼┤" shape, a "⊥" shape, and a "E" shape will be described in detail with reference to FIGS. 6A to 6G, by way of examples.

Figure 6A:
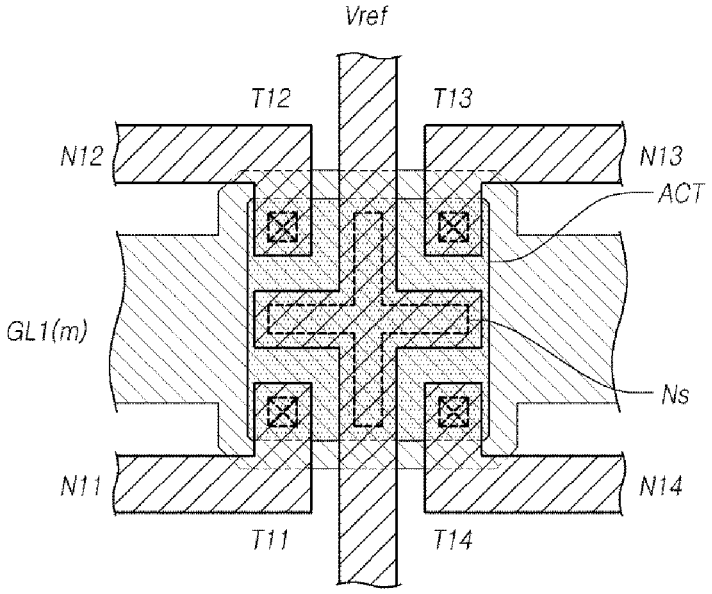
FIGS. 6A to 6G illustrate cases in which a shared node (Ns) has a "+" shape, a "⊢⊣" shape, a "⊥" shape, or a "E" shape, by way of examples.

Referring to FIGS. 4A and 6A, the four first transistors T11, T12, T13, and T14 of the pixel P1connected with the $(4n-3)^{th}$ data line DL(4*n*−3), the pixel P2 connected with the $(4n-2)^{th}$ data line DL(4*n*−2), the pixel P3 connected with the $(4n-1)^{th}$ data line DL(4*n*−1), and the pixel P4 connected with the $(4n)^{th}$ data line DL(4*n*) share the shared node Ns which has the "┼" shape and is formed integrally with the reference voltage line, and each of the respective nodes N11, N12, N13, and N14 is individually formed.

At this time, the respective nodes N12 and N13 of the first transistors T12 and T13 included in each of the pixel P2 connected with the $(4n-2)^{th}$ data line DL(4*n*−2) and the pixel P3 connected with the $(4n-1)^{th}$ data line DL(4*n*−1) are directly connected with the first node N1 of the driving transistor DT. In addition, the respective nodes N11 and N14 of the first transistors T11 and T14 included in each of the pixel P1 connected with the $(4n-3)^{th}$ data line DL(4*n*−3) and the pixel P4 connected with the $(4n)^{th}$ data line DL(4*n*) are connected with the first node N1 of the driving transistor DT through the connection pattern CP.

A (e.g., one) semiconductor layer or active layer ACT may be positioned between the shared node Ns and four respective nodes N11, N12, N13, and N14. Four first transistors T11, T12, T13, and T14 are controlled by the first scan signal supplied to a gate node which is integral with the first gate line GL1(*m*) positioned below the semiconductor layer or active layer ACT or is connected with the first gate line GL1(*m*).

Although the semiconductor layer or active layer ACT may exist as one common layer between the shared node Ns and four respective nodes N11, N12, N13, and N14 as illustrated in FIG. 6A, the semiconductor layer or active layer ACT may exist as four separate layers between the shared node Ns and four respective nodes N11, N12, N13, and N14. In addition, although it has been described by way of an example that four first transistors T11, T12, T13, and T14 are bottom gate structures in which the gate node is positioned below the source/drain node, the first transistors T11, T12, T13, and T14 may be top gate structures in which the gate node is positioned above the source/drain node.

Figure 6B:
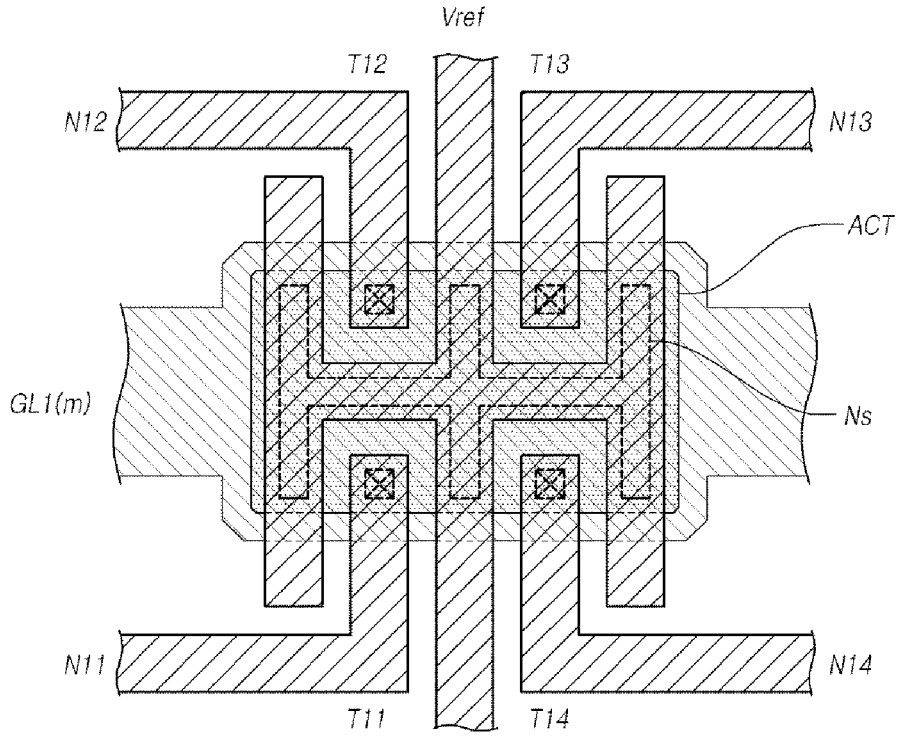
Figure 6C:
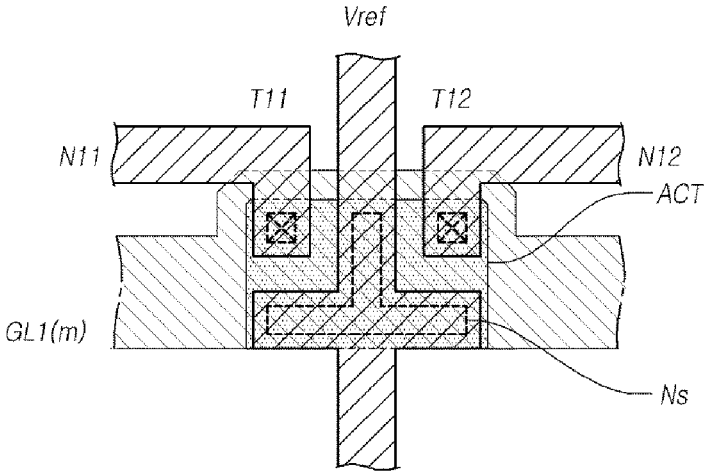
Figure 6D:
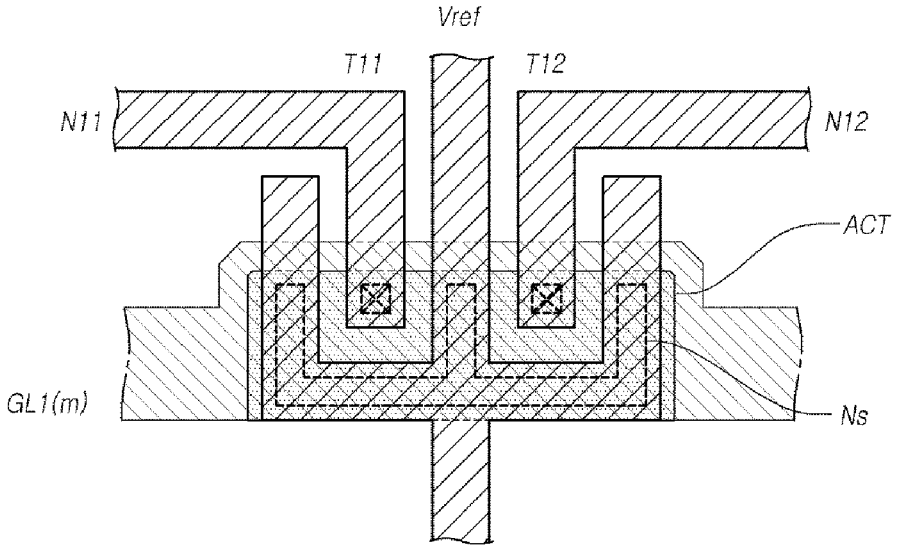

Referring to FIG. 6B, four first transistors T11, T12, T13, and T14 of four pixels P1 to P4 share a shared node Ns of a "├┼┤" shape which is formed integrally with the reference voltage line and respective nodes N11, N12, N13, and N14 are individually formed.

Although it has been described in the above-described embodiment that four pixels P1 to P4 are symmetric with reference to the reference voltage line, the four first transistors T11, T12, T13, and T14 of the four pixels P1 to P4 share the shared node Ns formed integrally with the reference voltage line, and each of respective nodes N11, N12, N13, N14 is individually formed, two pixels may be positioned at opposite sides with reference to the reference voltage line (symmetrically or asymmetrically), two first transistors T11 and T12 of two pixels P1 and P2 may share a shared node Ns having a "⊥" shape (illustrated in FIG. 6C) or a "└┘" shape (illustrated in FIG. 6D) which is integrally formed with the reference voltage line, and each of the respective node N11 and N12 may be individually formed. That is, in one or more embodiments, first source/drain nodes (e.g. source nodes or drain nodes) of two first transistors (e.g., T11 and T12 shown in FIG. 6C and FIG. 6D) may be configured as the shared node Ns formed integrally with the reference voltage line RVL while second source/drain nodes (e.g. drain nodes or source nodes) of the two first transistors (e.g., T11 and T12) may be configured as individual nodes (e.g., N11 and N12 shown in FIG. 6C and FIG. 6D).

Figure 6E:
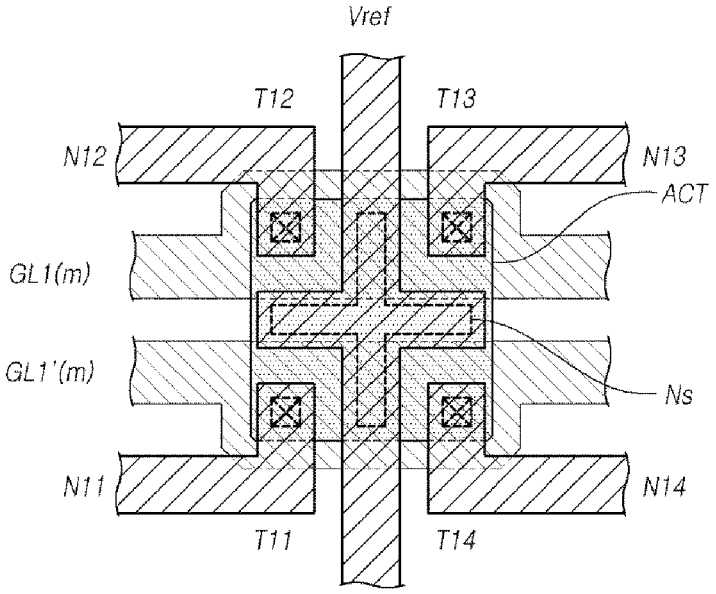
Figure 6F:
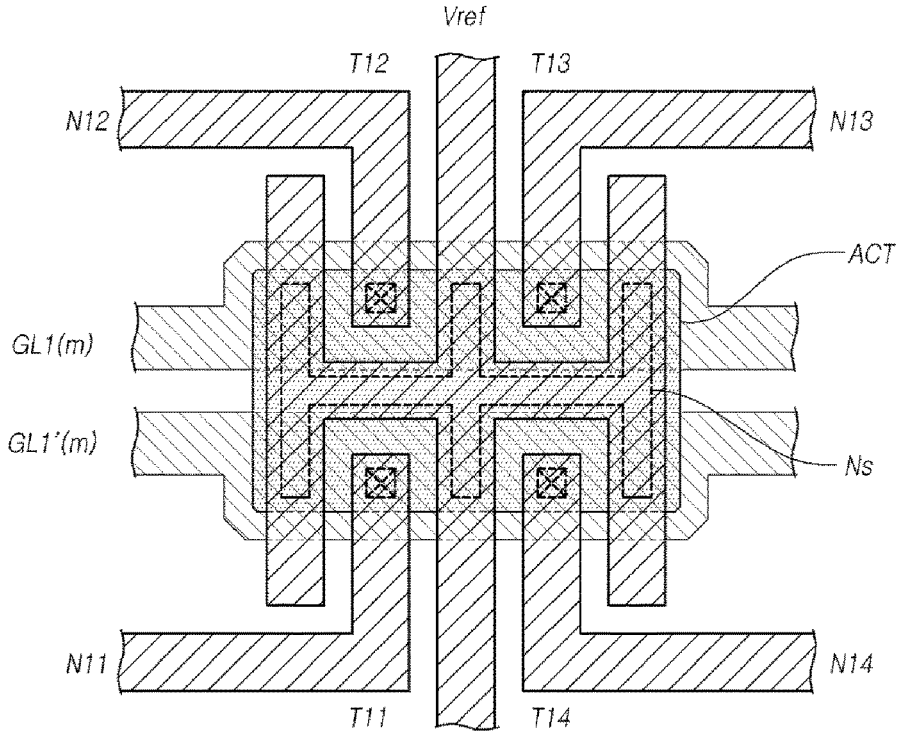

In addition, although it has been described in the above-described embodiment that four first transistors T11, T12, T13, and T14 of four pixels P1 to P4 are controlled by a first scan signal supplied through one first gate line GL1(*m*) that supplies a first scan signal in a 3T1C-based 2-scan structure, or through one common first gate line GL(m) that supplies a first scan signal and a second scan signal in a 3T1C-based 1-scan structure, four first transistors T11, T12, T13, and T14 may be controlled by two first scan signals supplied through two first gate lines GL1(*m*) and GL1'(m), as illustrated in FIGS. 6E and 6F, or four first transistors T11, T12, T13, and T14 may be controlled by four first scan signals supplied through four first gate lines, respectively (not shown). For example, first transistors T11 and T14 may be controlled by a first scan signal supplied through a first gate line GL1(*m*), while first transistors T12 and T13 may be controlled by a second first scan signal supplied through a second first gate line GL1'(m), as shown in FIGS. 6E and 6F.

Figure 6G:
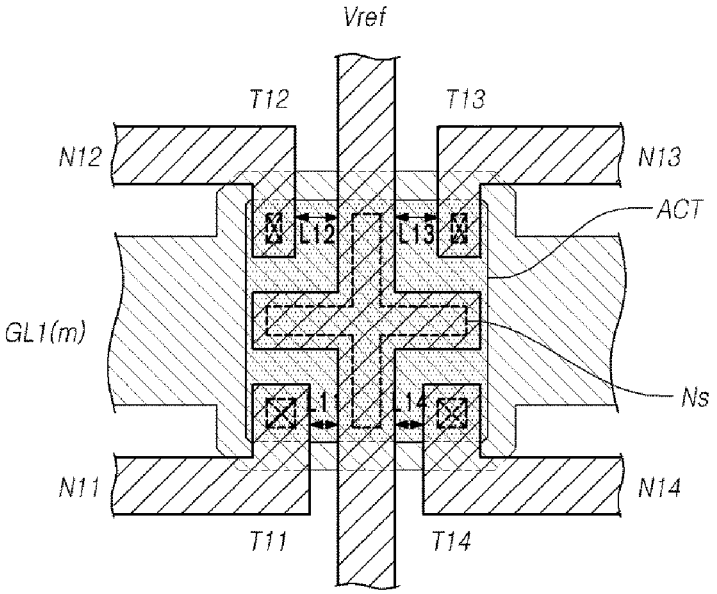

In addition, it has been described in the above-described embodiments that the distance (e.g. widths/lengths) between the shared node of four first transistors T11, T12, T13, and T14 of four pixels P1 to P4and four respective nodes are all equal to each other, the distance (e.g. width/length) between the shared node and respective node of at least one of four first transistors T11, T12, T13, and T14 may be different from that of another first transistor. For example, as illustrated in FIG. 6G, among four first transistors T11, T12, T13, and T14, the distances (widths/lengths) L12 and L13 between the shared node Ns and two respective nodes N12 and N13 may be different from the distances (widths/lengths) L11 and L14 between the shared node and the other two respective nodes N11 and N14. In other words, the distances L11 and L14 between the shared node Ns and the other two respective nodes N11 and N14 may be longer than the distances (widths/lengths) L12 and L13 between the shared node Ns and two respective nodes N12 and N13. Therefore current gains of two transistors T11 and T14 may be larger than those of two transistors T12 and T13.

In addition, although it has been described that the four first transistors T11, T12, T13, and T14 described above with reference to FIGS. 5 and 6 are associated with the four pixels P1 to P4 of the display panel 11 of the display device 10 described with reference to FIG. 1, the transistor structure described with reference to FIGS. 5 and 6 may be included in any type of display device. At this time, the transistor structure for a display device includes two or more transistors which share a voltage line of one direction that supplies a voltage to pixels and one of drains and sources integrally formed with the voltage line, and respectively include the other of the drains and sources which are formed separately and connected to different nodes directly or through a connection pattern. This transistor structure is referred to as a rotary transistor.

Figure 7:
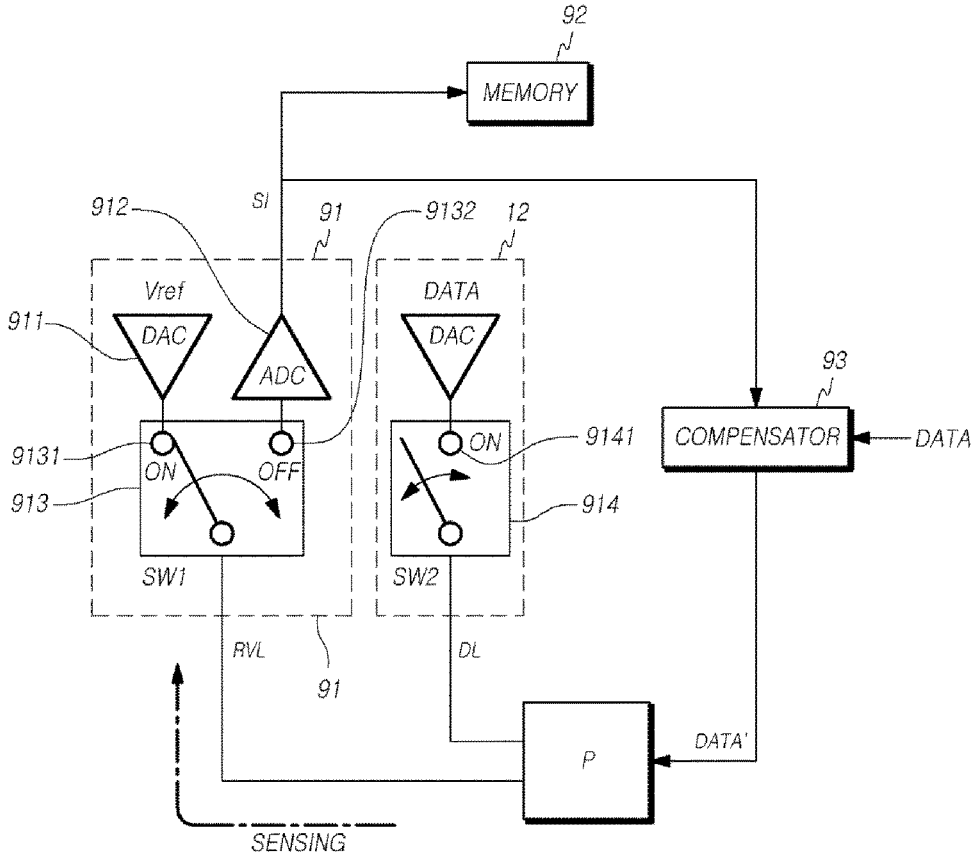
FIG. 7 is a diagram briefly illustrating an external compensation configuration included in an organic light emitting display device according to embodiments of the present invention.

FIG. 7 is a diagram briefly illustrating an external compensation configuration included in an organic light emitting display device 10 according to embodiments of the present invention.

Referring to FIG. 7, in order to compensate for characteristic (e.g., threshold voltage and/or mobility) deviations of the driving transistor DT (in other words, deviations in characteristics of the driving transistor DT) in each pixel P which may cause unbalanced luminance among pixels, the organic light emitting display device 10 according to embodiments of the present invention may include, as a compensation configuration, a sensor 91 configured to sense a voltage for determining characteristic information (in other words, information representing characteristics) of a driving transistor DT (e.g., threshold voltage and/or mobility), a memory 92 configured to store the sensed voltage, a compensator 93 configured to determine the characteristic information of the driving transistor DT based on the sensed voltage and compensate for the characteristic information.

The sensor 91 may sense a voltage for determining characteristic information of the driving transistor DT in each pixel P, in particular the voltage of the first node N1 of the driving transistor DT of each pixel P.

As illustrated in FIG. 7, the sensor 91 may include, for example, a Digital to Analog Converter (DAC) 911 configured to convert the reference voltage Vref supplied from a reference voltage source into an analog value, an Analog to Digital Converter (ADC) 912 configured to convert the voltage sensed at the first node N1 of the driving transistor DT of each pixel connectable with the sensor 91 to a digital value, and a first switch 913 configured to perform switching so as to cause one of reference voltage supply node 9131 which is supplied with the reference voltage Vref which is converted into an analog value by the digital to analog converter 911 and a sensing node 9132 connected to the analog to digital converter 912 to be connected with a reference voltage line RVL.

In order to sense the voltage for determining the characteristic information of the driving transistor DT, it is necessary to apply a predetermined voltage to each of the first node N1 and the second node N2 of the driving transistor DT, to cause the voltage at the first node N1 of the driving transistor DT to be varied, and to measure the varied voltage as a sensing voltage.

In connection with this, when the reference voltage supply node 9131 and the reference voltage line RVL are connected with each other by the switch 913, the reference voltage Vref, which is converted into an analog value by the digital to analog converter 911, is applied to the first node N1 of the driving transistor DT. Then, a predetermined voltage should also be applied to the second node N2 of the driving transistor DT. One embodiment of the present invention applies a data voltage Vdata to the second node N2 of the driving transistor DT from the data line DL connected with the corresponding pixel. Thereafter, in order to sense the varied voltage at the first node N1 of the driving transistor DT, one embodiment of the present invention may include a (e.g., one) second switch 914 in each data line, in which the second switch 914 performs switching such that a data voltage output point 9141 of the data driver 12 is turned ON to be connected with the corresponding data line DL or the data voltage output point 9141 of the data driver 12 is turned OFF to be floated with the corresponding data line DL, as illustrated in FIG. 7. The second switch 914 may be considered as a component which is functionally included in the sensor 91 corresponding to the corresponding pixel P.

The sensor 91 described above may be included in the inside or outside of the data driver 12.

A plurality of sensors 91 may be provided, in which case, each sensor 91 may be provided per one data line, or per some data lines. In addition, each sensor 91 may be provided per one reference voltage line RVL.

The sensor 91 stores the sensed voltage in the memory 92 in digital form or transmits the sensed voltage to the compensator 93 so that the characteristic information of the driving transistor DT can be compensated for.

After receiving the sensed voltage from the sensor 91, the compensator 93 is capable of performing data conversion processing based on the voltage transmitted from the sensor 91 in digital form so as to compensate for the characteristic information of the driving transistor DT including one or both of a threshold voltage and mobility.

The above-mentioned compensator 93 may be located at any position within the organic light emitting display device 10 as long as it can receive the sensed voltage in digital form from the sensor 91.

For example, the compensator 93 may be implemented to be included within the timing controller 14, within the data driver 12, or outside of the timing controller 14 and data driver 12.

Figure 8:
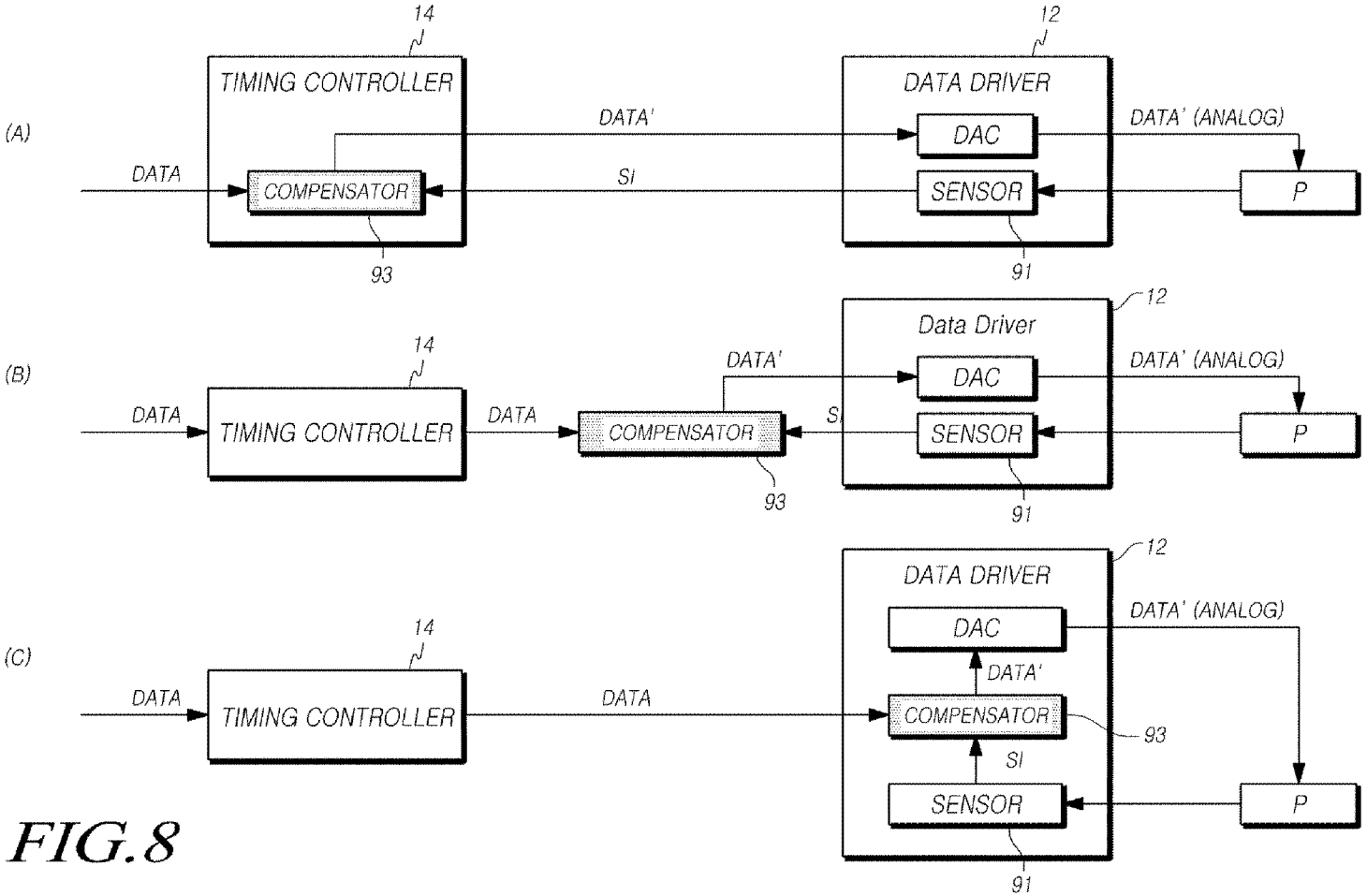
FIG. 8 is a diagram illustrating a method of implementing an external compensation configuration included in an organic light emitting display device according to embodiments of the present invention.

FIG. 8 is a diagram conceptually exemplifying methods of implementing external compensation configurations included in an organic light emitting display device 10 according to embodiments of the present invention, in particular (A) a case, in which the compensator 93 is implemented to be included within the timing controller 14, (B) a case, in which the compensator 93 is implemented to be included outside of the timing controller 14 and the data driver 12, and (C) a case, in which the compensator 93 is implemented to be included in the data driver 12.

In FIG. 8, it is assumed that the sensor 91 is implemented to be included in the data driver 12.

Referring to FIG. 8(A), in the case where the compensator 93 is implemented to be included within the timing controller 14, the voltage SI sensed in the corresponding pixel P by the sensor 91 is transmitted to the compensator 93 within the timing controller 14, and the compensator 93 included within the timing controller 14 may determine the characteristic information of the driving transistor DT based on the voltage SI transmitted from the sensor 91, convert, based on this, the data supplied from the outside (Data) into transmitted compensation data (Data') and supply the compensation data (Data') to the Digital to Analog Converter (DAC) within the data driver 12. As a result, the DAC within the data driver 12 converts the compensation data in digital form (Data') supplied from the compensator 93 into analog data and supplies the converted compensation data to the corresponding pixel P.

Referring to FIG. 8(B), in the case where the compensator 93 is implemented to be included outside of the timing controller 14 and the data driver 12, the voltage SI sensed by the sensor 91 from the corresponding pixel P is transmitted to the compensator 93 located outside of the data driver 12 and the timing controller 14, the compensator 93 may determine the characteristic information of the driving transistor DT based on the voltage SI transmitted from the sensor 91, convert, based on the characteristic information, data supplied from the timing controller 14 (Data) into compensation data (Data'), and supply the compensation data to the data driver 12. The data driver 12 converts the compensation data in digital form (Data') supplied from the compensator 93 into analog data through the DAC located therein, and supplies the converted compensation data to the corresponding pixel P.

Referring to FIG. 8(C), in the case where the compensator 93 is implemented to be included in the data driver 12, the sensor 91 within the data driver 12 transmits the voltage SI sensed from the corresponding pixel P to the compensator 93 within the data driver 12, the compensator 93 may determine the characteristic information of the driving transistor DT based on the voltage SI transmitted from the sensor 91, convert, based on this, the data supplied from the timing controller 14 (Data) into compensation data (Data'), and supply the compensation data to the DAC. As a result, the DAC converts the compensation data in digital form (Data') supplied from the compensator 93 into an analog form, and supplies the compensation data (data voltage) converted into the analog form to the corresponding pixel P.

In FIG. 8(B) and FIG. 8(C), in the method of receiving the data (Data), the compensator 93 may be supplied with the data directly from the timing controller 14. However, when the timing controller 14 stores the data in the memory, the compensator 93 may be supplied with the data in the manner of reading the data stored in the memory.

The implementation example of the compensator 93 illustrated in FIG. 8(A) to FIG. 8(C) is a digital-based compensation method (data conversion method) that performs compensation by converting the data in digital form (Data) into compensation data in digital form (Data'). In this case, the compensation data in digital form (Data') may be generated through calculation processing that adds/subtracts a digital value of the characteristic information of the driving transistor DT to/from the data in digital form (Data).

Figure 9A:
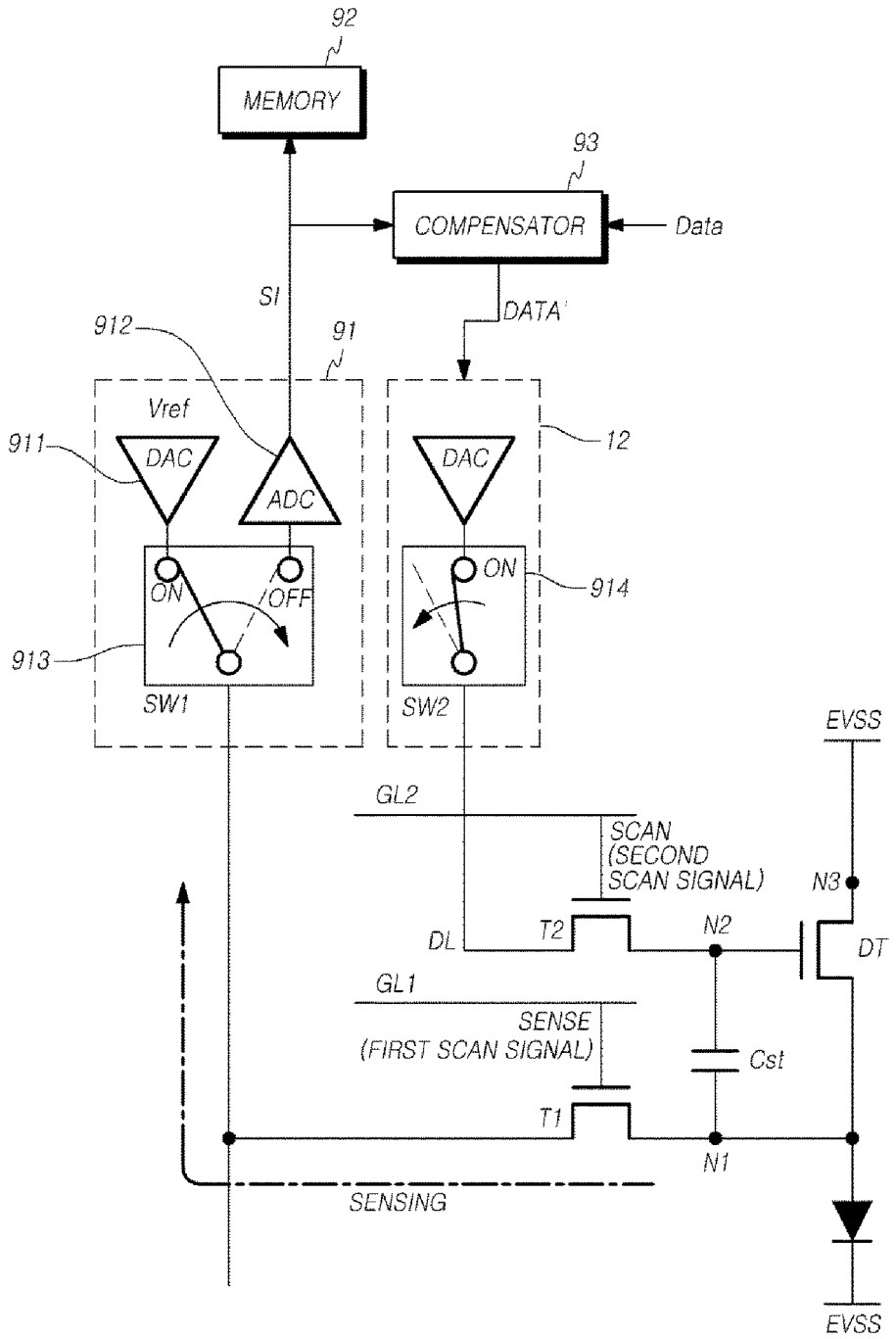
FIG. 9A is a diagram illustrating an external compensation configuration of an organic light emitting display device according to one embodiment of the present invention together with an equivalent circuit for one pixel, with respect to the implementation method of FIG. 8.
Figure 9B:
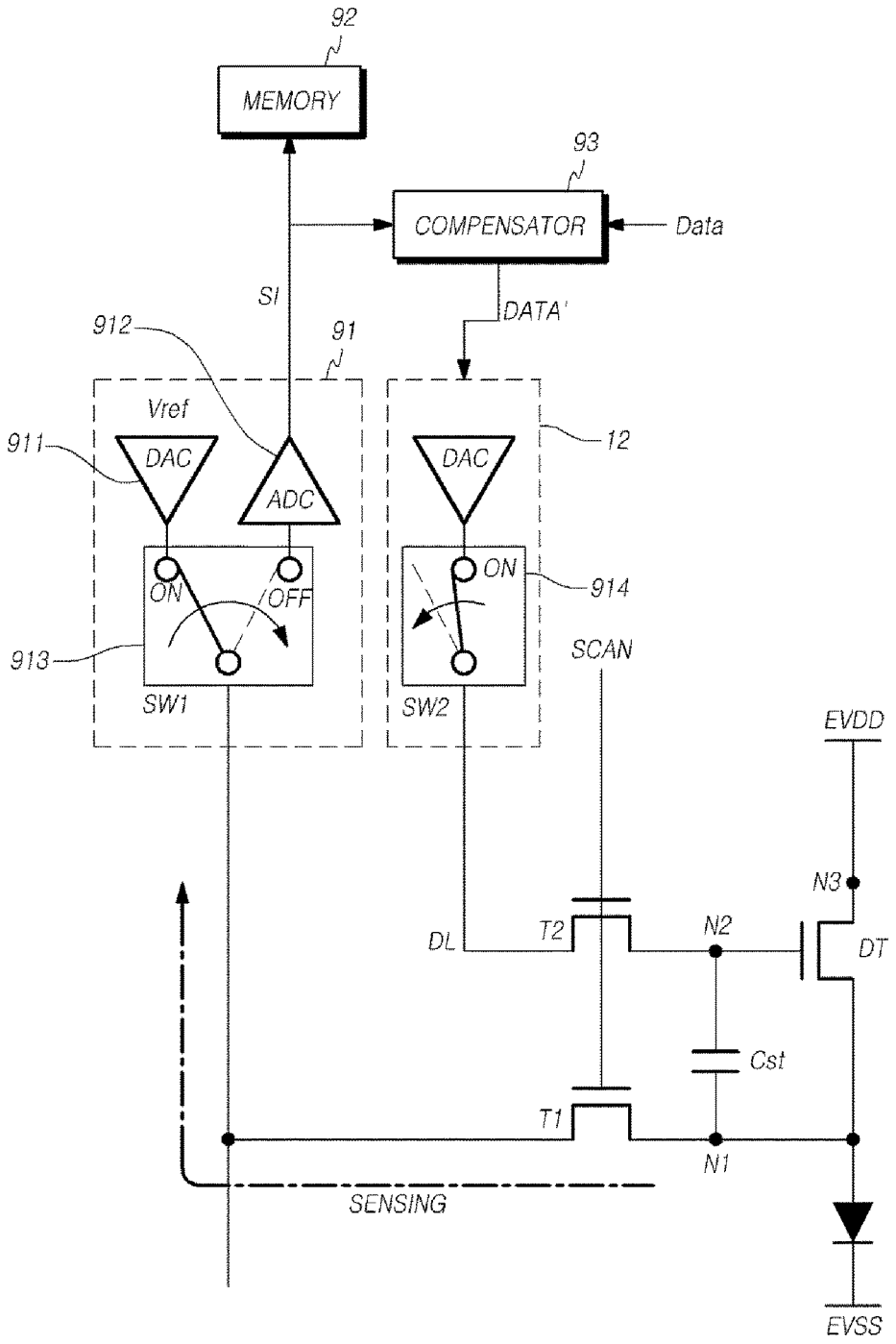
FIG. 9B is a diagram illustrating an external compensation configuration of an organic light emitting display device according to another embodiment of the present invention together with an equivalent circuit for one pixel, with respect to the implementation method of FIG. 8.

FIG. 9A is a diagram illustrating an external compensation configuration of an organic light emitting display device according to one embodiment of the present invention together with an equivalent circuit for one pixel, with respect to the implementation method of FIG. 8. FIG. 9B is a diagram illustrating an external compensation configuration of an organic light emitting display device according to another embodiment of the present invention together with an equivalent circuit for one pixel, with respect to the implementation method of FIG. 8.

Meanwhile, when the number of the reference voltage lines and the number of data lines are equal to each other, that is, when one reference voltage line exists in each pixel P arranged in the horizontal direction (the other direction), sensors 91 respectively corresponding to pixels P arranged in the horizontal direction (the other direction) may exist. Then, a sensing operation may be performed for all the pixels arranged in the horizontal direction (the other direction) simultaneously. That is, in FIG. 5, when reference voltage lines RVL exist to correspond to four pixels P1 to P4, respectively, the varied voltages at the first nodes N1 of the driving transistors DT in four respective pixels P1 to P4 may be simultaneously sensed.

However, when the number of reference voltage lines is smaller than the number of data lines, for example, when the number of reference voltage lines is ¼ of the number of data lines, that is, one reference voltage line exists per every four pixels P arranged in the horizontal direction (the other direction), it is impossible to perform the sensing operation for all the pixels arranged in the horizontal direction (the other direction) simultaneously. The sensing operation may be performed for one pixel per every four pixels. That is, when one reference voltage line RVL exists for four pixels P1 to P4 as in FIG. 5, the varied voltages at the first nodes N1 of driving transistors DT of the four respective pixels P1 to P4 cannot be simultaneously sensed, and at a specific time point, only the varied voltage of the first node N1 of the driving transistor DT of one pixel among the four pixels P1 to P4 can be sensed.

Accordingly, at the specific time point a function may be required for selecting a pixel for sensing the varied voltage at the first node N1 of the driving transistor DT among the four pixels P1 to P4.

Figure 10:
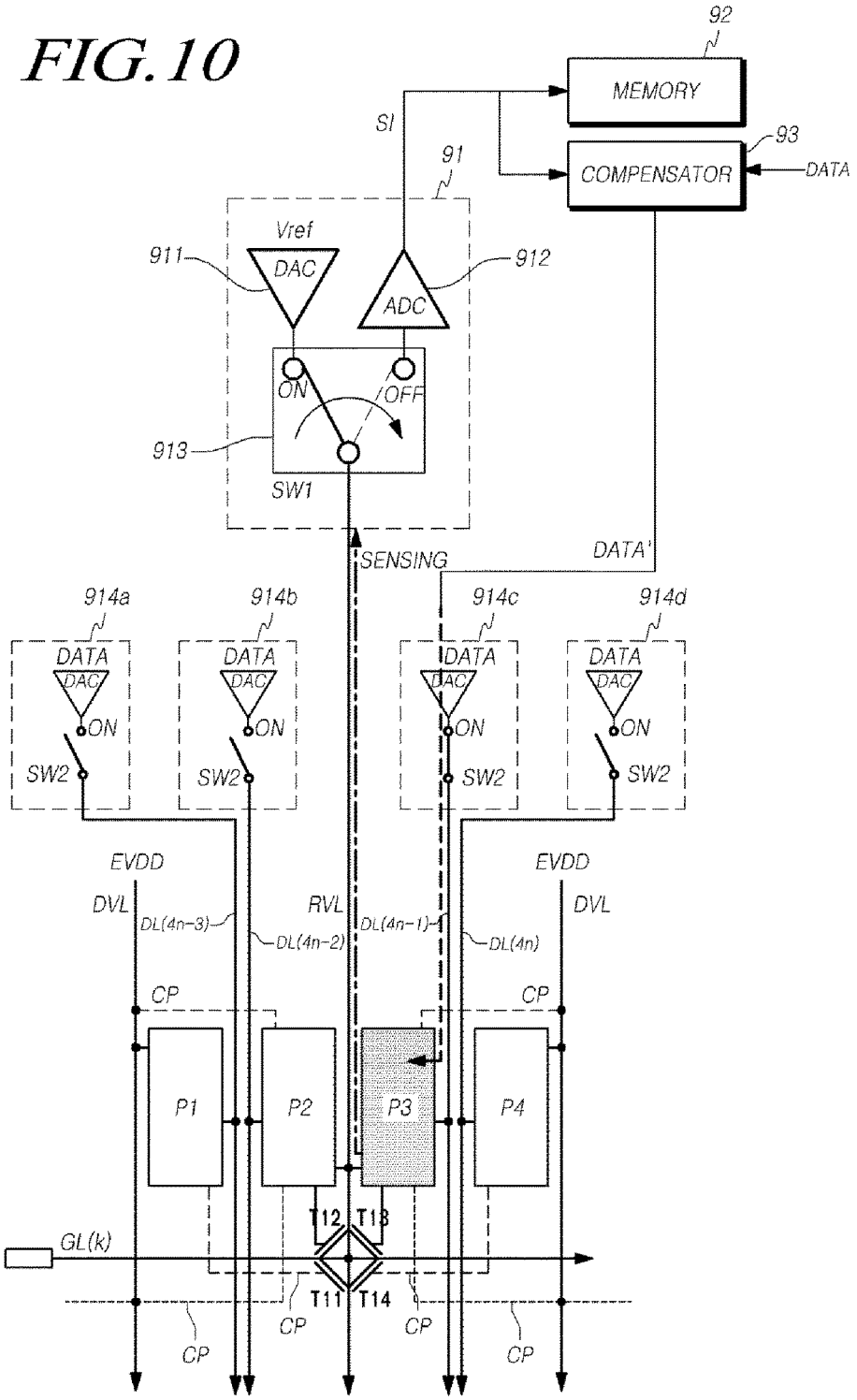
FIG. 10 is a diagram illustrating an external compensation configuration according to the implementation method of FIG. 8 together with a plurality of pixels.

FIG. 10 is a diagram illustrating an external compensation configuration according to the implementation method of FIG. 8 together with a plurality of pixels P1 to P4.

FIG. 10 illustrates a method in which a pixel P3 connected with a (4n−1)th data line DL(4*n*−1) among four pixels P1 to P4 is selected, a varied voltage at the first node N1 of the driving transistor DT of the selected pixel is sensed so as to determine and compensate for characteristic information (threshold voltage and/or mobility) of the driving transistor DT of the sensed pixel.

Referring to FIG. 10, in order to select the pixel P3 connected with the (4n−1)th data line DL(4*n*−1) among the four 4 pixels P1 to P4, a timing controller 14 may send a control signal (second control signal) to each sensor 91 or data driver 12 that causes only a second switch 914*c*, which switches the connection between the pixel P3 and the (4n−1)th data line DL(4*n*−1), to be turned ON, and causes the remaining second switches 914*a*, 914*b*, and 914*d* to be turned OFF, among four second switches 914*a*, 914*b*, 914*c*, 914*d* that switch the connection between the four pixels P1 to P4 and four data lines DL(4*n*−3), DL(4*n*−2), DL(4*n*−1) and DL(4*n*) capable of supplying the data voltage.

Figure 11:
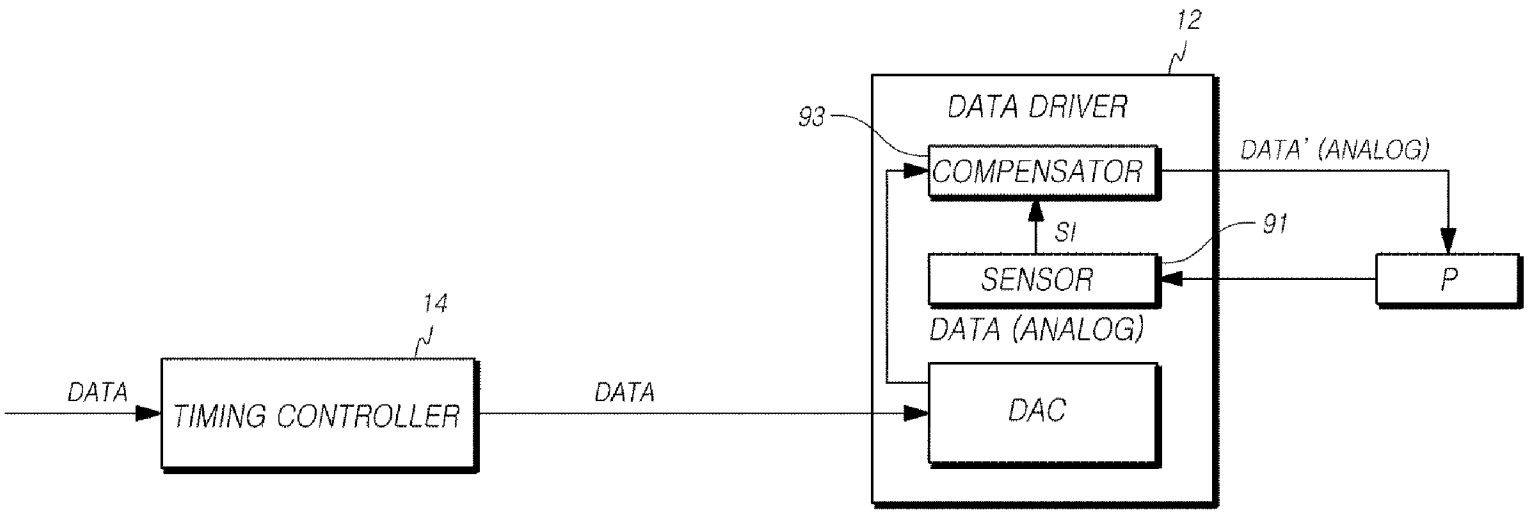
FIG. 11 is a diagram illustrating another method of implementing an external compensation configuration included in an organic light emitting display device according to embodiments of the present invention.

Meanwhile, besides the implementation examples of the compensator 93 illustrated in FIG. 8(A) to FIG. 8(C), that is, the digital-based compensation method (data conversion method), according to another implementation example as illustrated in FIG. 11, the data driver 12 receives data in digital form (Data) supplied from the timing controller 14, the DAC of the data driver 12 converts the data in digital form (Data) into an analog form using a gamma reference voltage, and the compensator 93 converts the characteristic information SI of the transistor DT transmitted from the sensor 91 into an analog value so that, based on the characteristic information converted into the analog value, the converted analog data (Analog Data) can be converted to generate a data voltage as compensation data. This method is a complete analog-based compensation method (data conversion method).

Figure 12A:
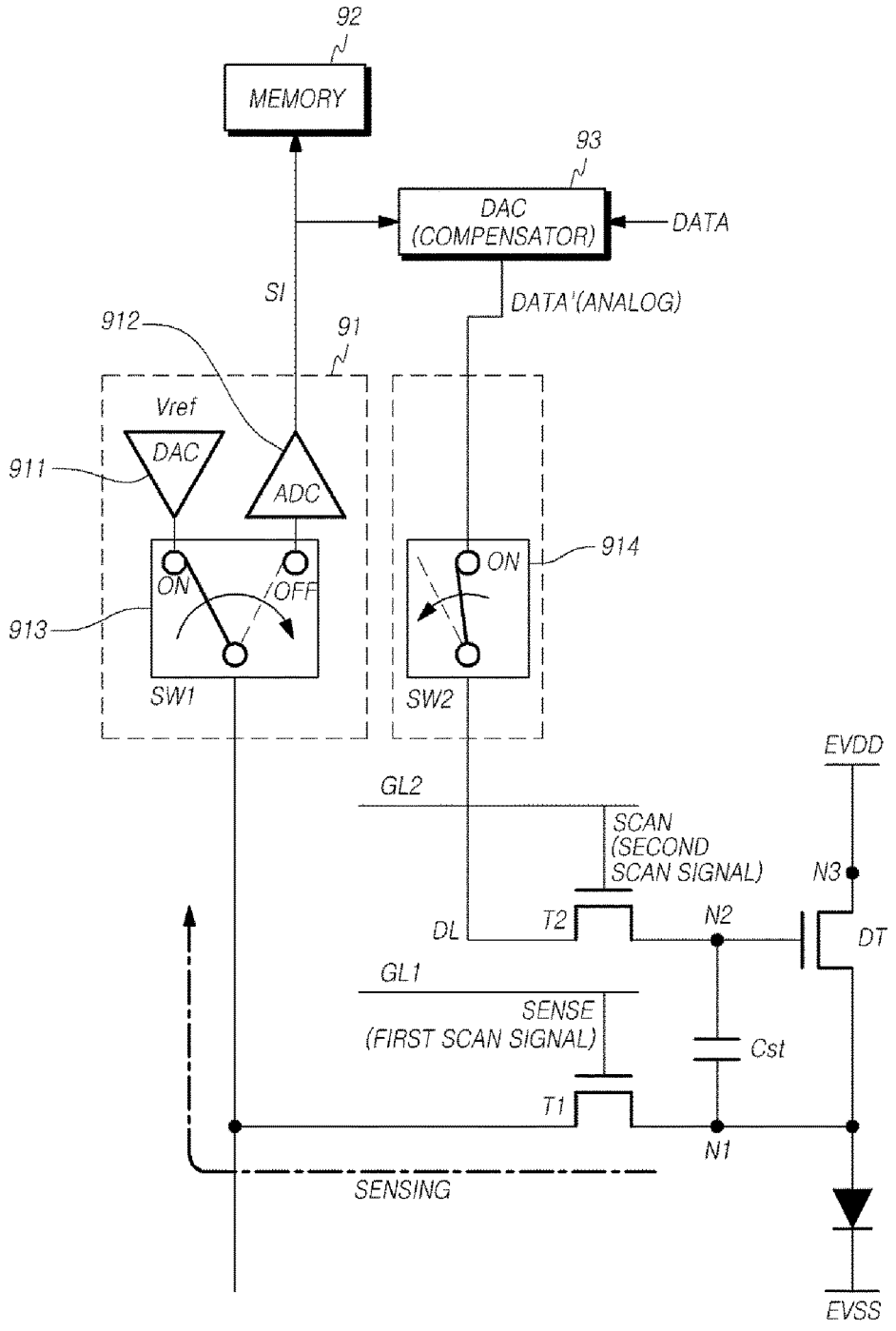
FIG. 12A is a diagram illustrating still another method of implementing an external compensation configuration included in an organic light emitting display device according to one embodiment of the present invention.
Figure 12B:
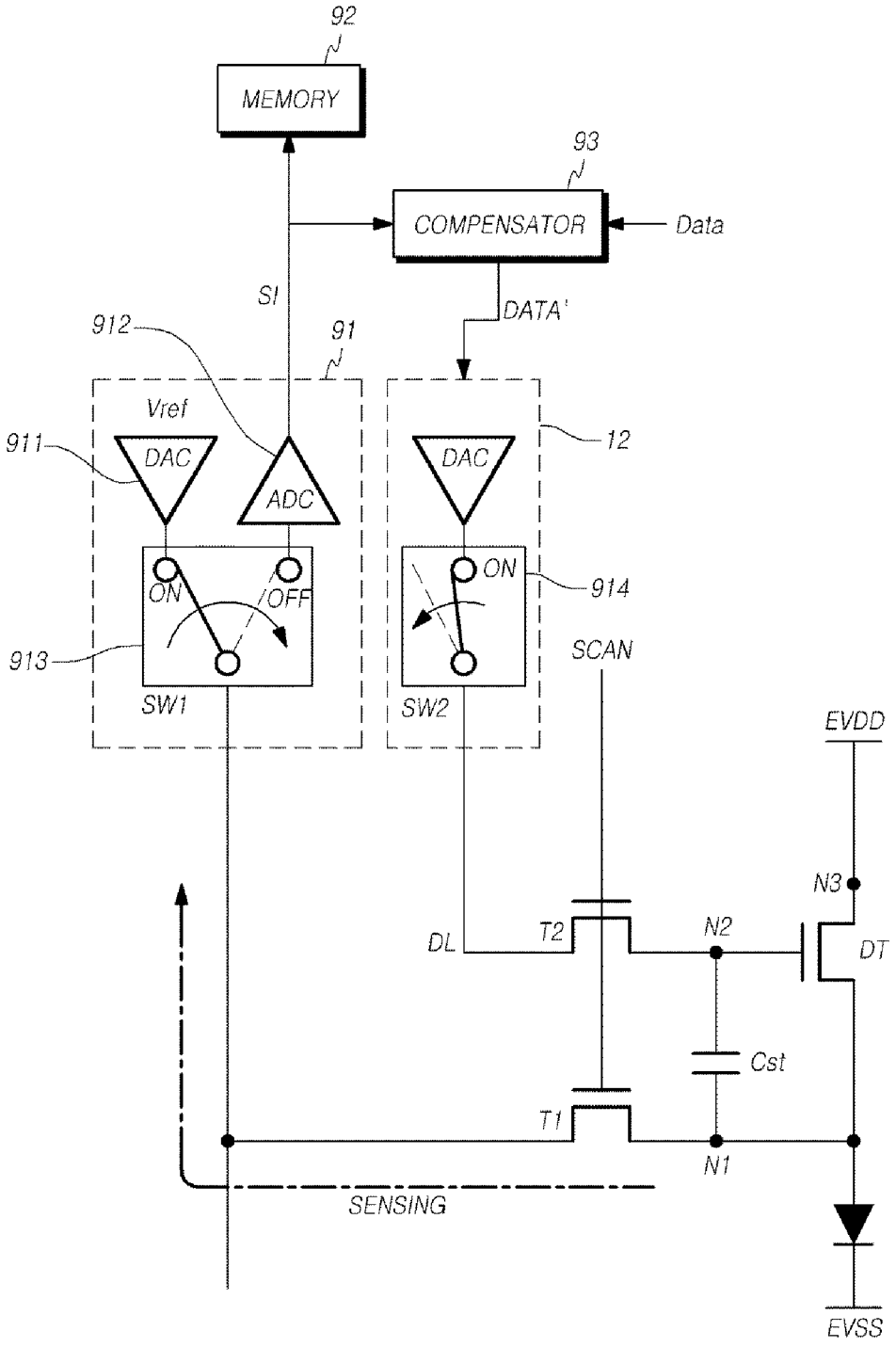
FIG. 12B is a diagram illustrating yet another method of implementing an external compensation configuration included in an organic light emitting display device according to another embodiment of the present invention.

Besides the complete analog-based compensation method, according to another implementation example as illustrated in FIGS. 12A and 12B, the data driver 12 may receive data in digital form (Data) supplied from the timing controller 14, and the DAC (including the compensator 93) of the data driver 12 may generate compensation data (Data') using the characteristic information of the transistor DT transmitted from the sensor 91 when converting the data in digital form (Data) into an analog form using a gamma reference voltage, and convert the compensation data into an analog form to generate a data voltage. Strictly speaking, this method converts data into a digital form. However, as the conversion is performed in a digital-to-analog conversion step (DAC step), this method is referred to as an analog-based compensation method (data conversion method).

In the foregoing, among the components of the entire system of the organic light emitting display device 10 according to the embodiments of the present invention, the display panel 11, the sensor 91, the compensator 93, etc. have been described, and hereinafter, a data driver 12, and a gate driver 13 will be briefly described with reference to FIGS. 13A, 13B, and 14.

Figure 13A:
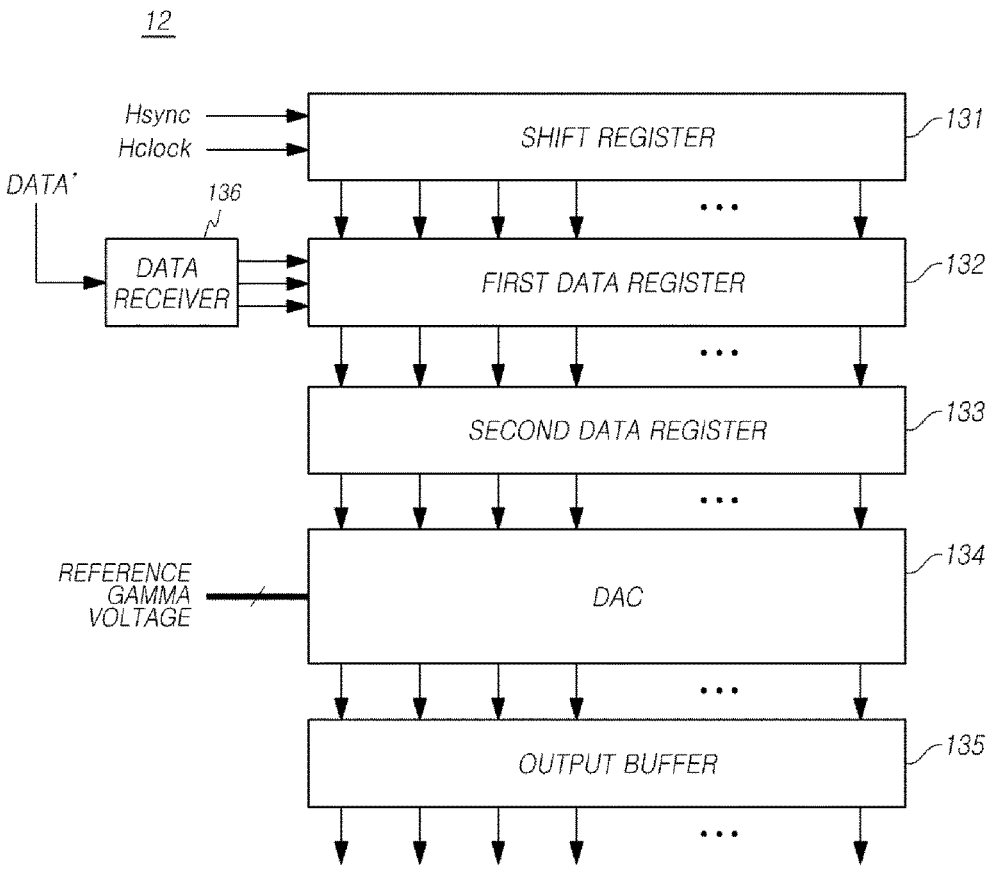
FIGS. 13A and 13B are diagrams illustrating configurations for data drivers included in an organic light emitting display device according to embodiments of the present invention.
Figure 13B:
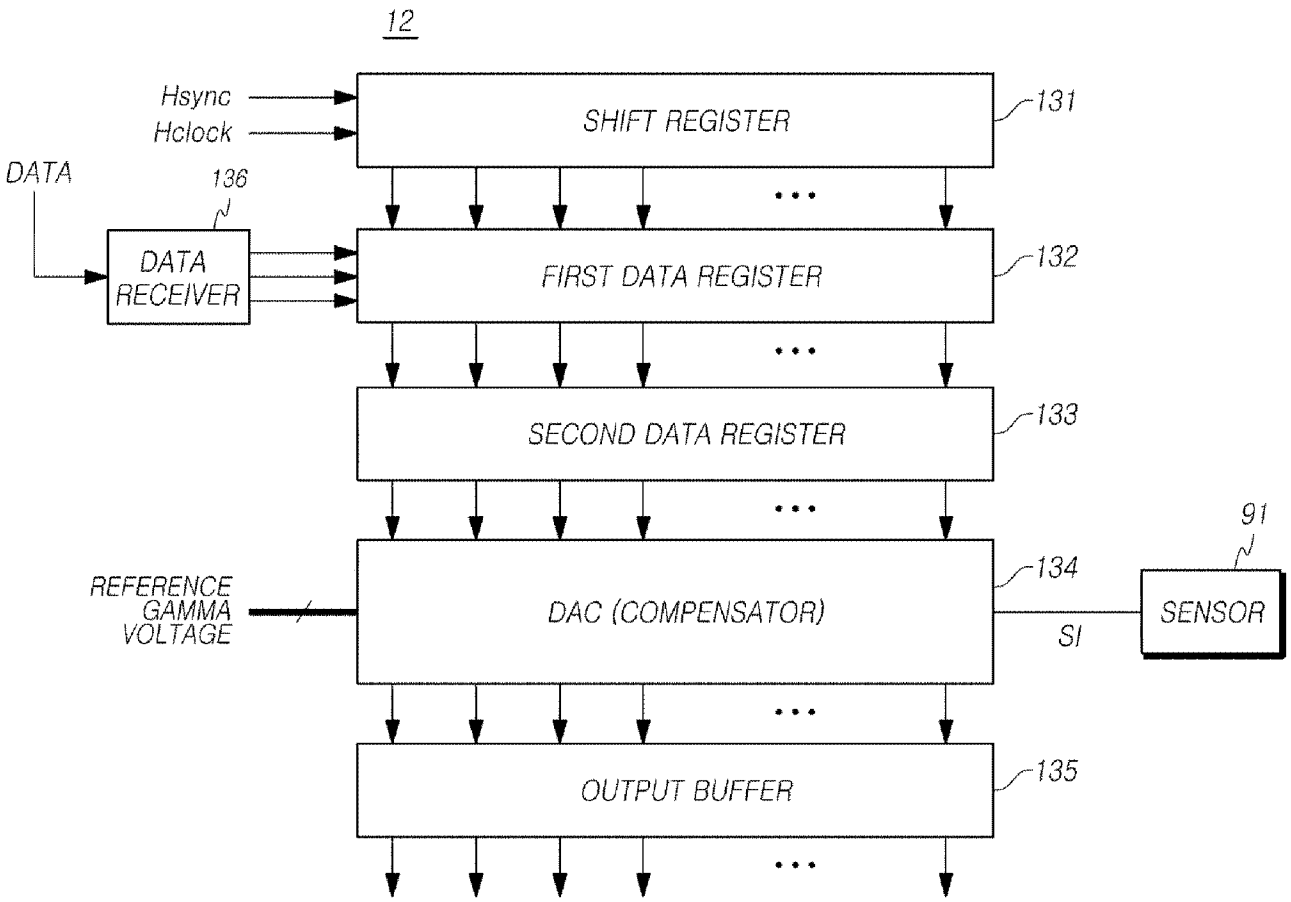

FIGS. 13A and 13B are diagrams illustrating configurations for data drivers 12 included in an organic light emitting display device 10 according to embodiments of the present invention.

FIG. 13A is a diagram illustrating the data driver in a case where a data driver 12 receives the compensation data to drive a data line, and FIG. 13B is a view illustrating a data driver including a compensator 93.

Referring to FIG. 13A, a data driver 12 included in the organic light emitting display device 10 according to one embodiment of the present invention includes, for example, a shift register 131, a first data register 132, a second data register 133, a digital to analog converter 134, an output buffer 135, and a data receiver 136.

The data receiver 136 receives compensation data (Data') from the compensator 93 included in the inside of the timing controller 14 or the data driver 12 or the compensator 93 included in the outside of the timing controller 14 and the data driver 12, converts the compensation data into predetermined bit digital data (in other words, digital data having a predetermined number of bits) for each of RGB and output the converted data, i.e. the predetermined bit digital data.

The shift register 131 controls an operating time with a horizontal clock signal Hclock and a horizontal synchronous signal Hsync for line-by-line driving. That is, the shift register 131 receives an input of the horizontal synchronous signal Hsync and the horizontal clock signal Hclock from the timing controller 14, and causes all the data (Data') corresponding to one gate line GL, which has selected the horizontal synchronous signal Hsync as a start signal, to be synchronized to the horizontal clock signal Hclock and to be sequentially sampled and stored in the first data register 132.

The first data register 132 sequentially stores data (Data') to be implemented by the pixels of the (m−1)th gate line GL($m$−1).

The second data register 133 stores the data (Data') stored in the first data register 132 according to the next horizontal synchronous signal Hsync. At this time, the data (Data') to be implemented by the pixels of the mth gate line GL(m) are sequentially stored in the first data register 132.

Each of the first data register 132 and second data register 133 described above may be implemented by a latch in which an input and an output are connected with each other through two inverters, and thus, the first data register 132 and the second data register 133 are also referred to as a first latch and a second latch, respectively.

The DAC 134 converts the data in digital form (Data') stored in the second data register 133 into an analog type data voltage with reference to a gamma reference voltage supplied from the outside.

The output buffer 135 amplifies a pixel driving force, that is, causes the data voltage to have a current driving capability sufficient for driving a data line, and supplies the data voltage through the data line.

FIG. 13B is a view illustrating a data driver 12 including the compensator 93.

Referring to FIG. 13B, the data driver 12 receives non-compensated data from the timing controller 14, and the compensator 93 included therein compensates for the data to be capable of driving the data line.

Since the data driver 12 illustrated in FIG. 13B receives non-compensated data unlike the data driver 12 illustrated in FIG. 13A, the functions of the data receiver 136 and the DAC 134 become different from each other.

Referring to FIG. 13B, the data receiver 136 receives an input of data (Data) prior to compensation from the timing controller 14, converts the data (Data) into bit digital data for each RGB/RWGB, and outputs the converted data.

The DAC 134 may convert the data in digital form (Data) stored in the second data register 133 into the analog type data voltage by further taking a sensing voltage SI further input from the sensor when it converts the data in digital form (Data) stored in the second data register 133 into the analog type data voltage with reference to the gamma reference voltage supplied from the outside. Accordingly, the DAC 134 included in the data driver (12) of FIG. 13B includes the compensator 93 as an internal component.

Figure 14:
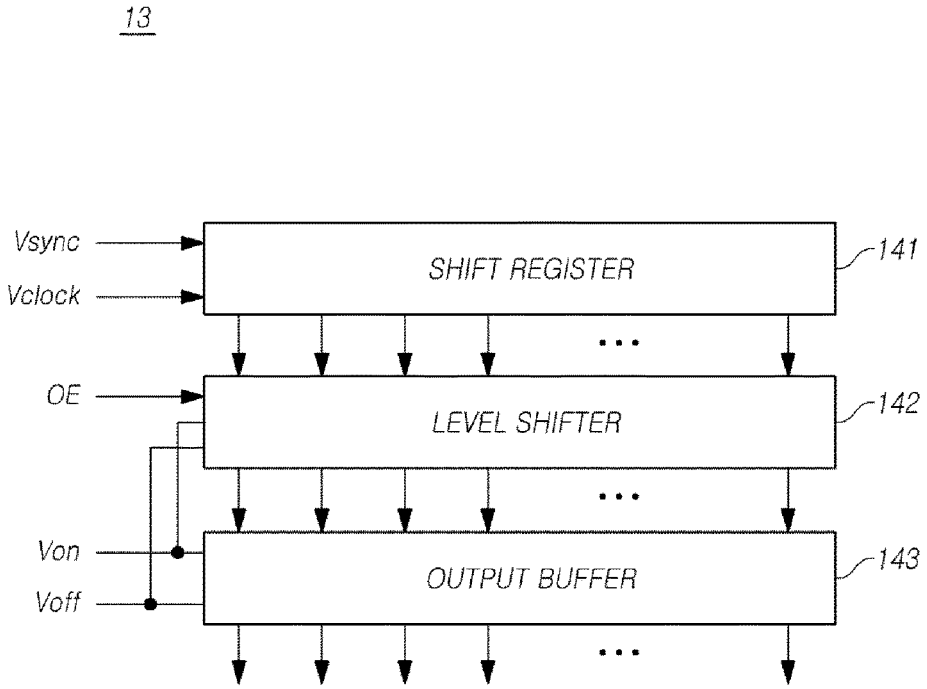
FIG. 14 is a diagram illustrating a configuration of a gate driver included in an organic light emitting display device according to embodiments of the present invention.

FIG. 14 is a diagram illustrating a configuration of a gate driver 13 included in an organic light emitting display device 10 according to embodiments of the present invention.

Referring to FIG. 14, a gate driver 13 included in an organic light emitting display device 10 according to one embodiment of the present invention includes, for example, a shift register 141, a level shifter 142, and an output buffer 143.

The shift register 141 starts generating scan pulses by receiving a vertical synchronous signal Vsync that notifies initiation of one frame from a timing controller 14, and causes the outputs of scan pulses to be sequentially turned ON according to a vertical clock signal Vclock. In addition, a logic arithmetic operation circuit may be included to prevent an influence of signal delay by shortening a charging time of a gate line using an output-enabled signal OE.

The level shifter 142 converts the scan pulses into a voltage that may turn ON/OFF first and second transistors T1 and T2 (included in each pixel). That is, depending on an ON voltage signal Von and an OFF voltage signal Voff, the level shifter 142 converts a low voltage into an ON voltage Von higher than a predetermined voltage required for turning ON or turning OFF the first and second transistors T1 and T2 and an OFF voltage Voff lower than the predetermined voltage.

The output buffer 143 may be configured as a circuit that outputs a scan signal by improving a current driving capability to be suitable for driving a gate line GL having an RC load.

Meanwhile, the gate driver 13 supplies the scan signal to the gate nodes of the first and second transistors T1 and T2 through one gate line GL.

In addition, the gate driver 13 may supply, according to a control signal from the timing controller 14, a scan signal which is maintained for one horizontal time HT or more at a scan signal level (second level VGH or first level VGL) which causes the first and second transistors T1 and T2 to be turned ON. Here, the one horizontal time may be a time, for which a data voltage is applied at the second level VGH. In this view point, supplying the scan signal that causes the first and second transistors T1 and T2 to be turned ON for one horizontal time or more means that the length of time in which the scan signal, which causes the first and second transistors T1 and T2 to be turned ON, is supplied may be equal to or longer than the length of time in which the data voltage is supplied at the second level VGH, that is, the scan signal, which causes the first and second transistors T1 and T2 to be turned ON, is supplied longer than the data voltage having the second level VGH.

In addition, the gate driver 13 may supply, according to a control signal of the timing controller 14, a scan signal, in which a time point where the scan signal is changed to the scan signal level (second level VGH or first level VGL), which causes the first and second transistors T1 and T2 to be turned ON is faster than a time point where the data voltage is applied.

As described above, the reason for supplying the scan signal, which is maintained for one horizontal time HT or more at a scan signal level (second level VGH or first level VGL) which causes the first and second transistors T1 and T2 to be turned ON, or supplying the scan signal, in which a time point where the scan signal is changed to the scan signal level (second level VGH or first level VGL), which causes the first and second transistors T1 and T2 to be turned ON is faster than a time point where the data voltage is applied, is for data charging.

Figure 15A:
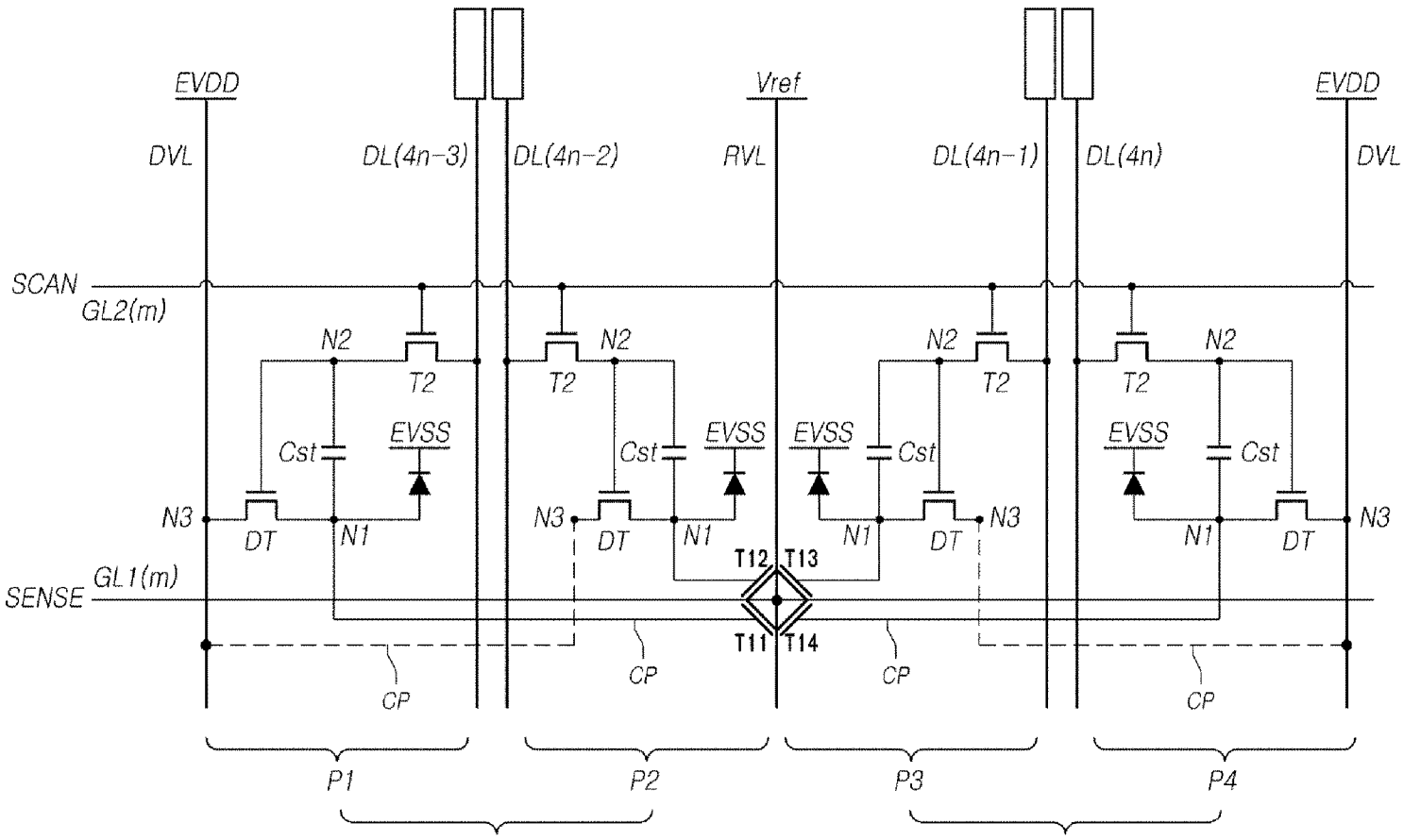
FIGS. 15A and 15B are diagrams comparatively illustrating numerical apertures of a display panel according to one embodiment of the present invention in which a shared node of first transistors of respective pixels is integrally configured with a reference voltage line, and a display device in which a first transistor of each pixel is configured in each pixel.
Figure 15B:
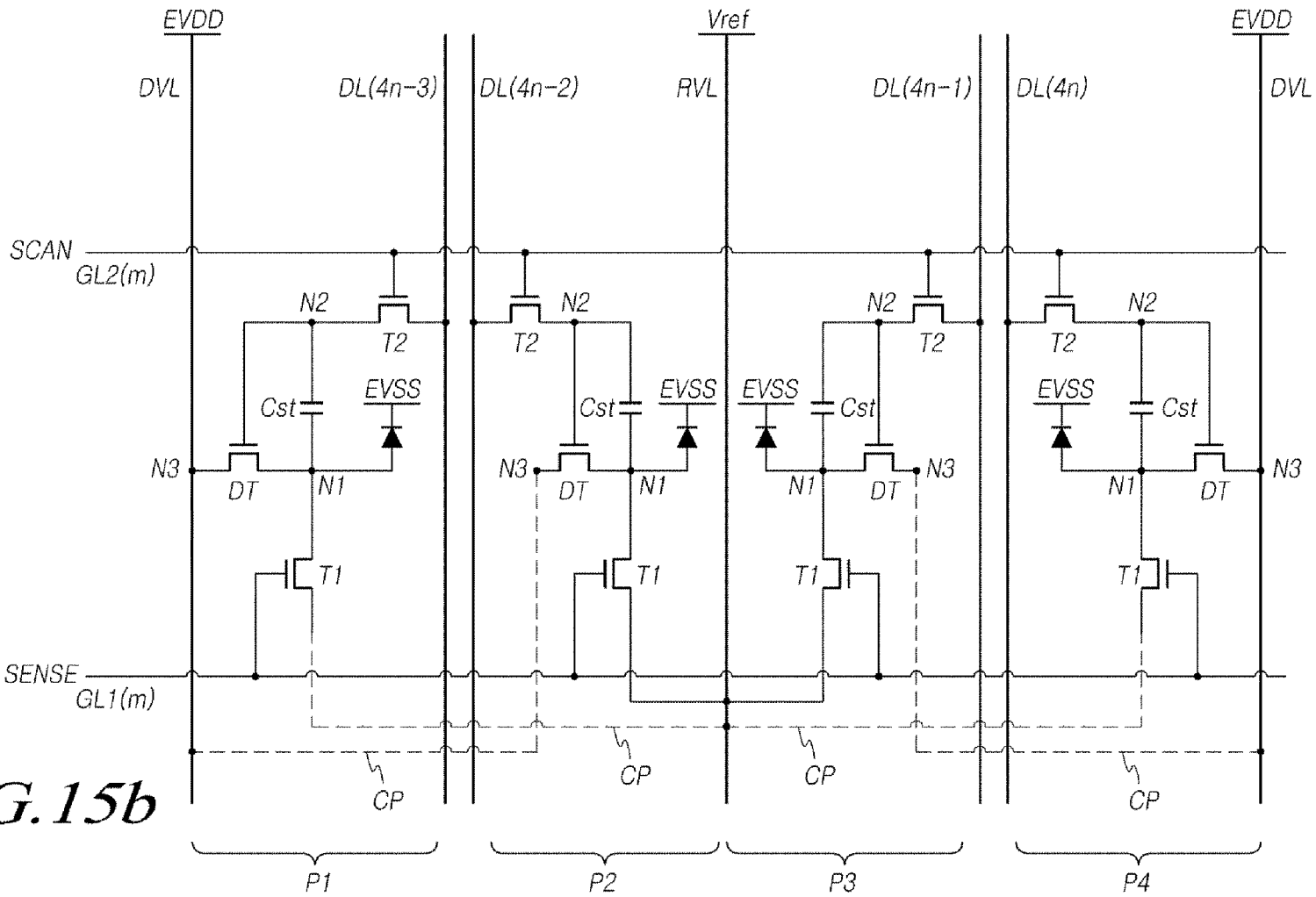

FIGS. 15A and 15B are diagrams comparatively illustrating numerical apertures of a display device according to one embodiment of the present invention in which a shared node of first transistors of respective pixels is integrally configured with a reference voltage line RVL, and a display device in which a first transistor of each pixel is configured in each pixel.

In a display device according to one embodiment of the present invention illustrated in FIG. 15A, a shared node of the first transistor of each pixel is formed integrally with a reference voltage line RVL. Whereas, in a display device illustrated in FIG. 15B, a first transistor for each pixel may be formed in each pixel.

In the display device illustrated in FIG. 15B, one reference voltage line RVL is shared by a unit of four pixels in a 3T1C structure. At this time, a connection wiring for sharing the reference voltage line RVL in a circuit part of the four pixels is needed, which in turn may lead to the reduction of a numerical aperture. In addition, since a design should be made in consideration of a process margin and repair margin of first transistors serving as respective sensing transistors, the practical numerical aperture is greatly reduced.

On the contrary, in the display device according to one embodiment of the present invention illustrated in FIG. 15A, the first transistors serving as the sensing transistors are positioned on the reference voltage line RVL, and the shared node of the first transistors serving as the respective sensing transistors is formed integrally with the reference voltage line RVL in order to solve the problem of the display device (FIG. 15B). Thus, the numerical aperture can be increased. A defect occurring due to the share of the reference voltage line RVL is equally divided into resistance components of respective pixels and the defect level can be reduced.

Accordingly, it may be understood that the display device according to one embodiment of the present invention illustrated in FIG. 15A has a display region (light emitting region) increased to further increase the numerical aperture as compared with that of the display device illustrated in FIG. 15B. From this, further improvement of the numerical aperture can be expected when the resolution or area is increased.

As described above, according to the present invention, it is possible to provide an organic light emitting display device 10 having a simple and compact panel structure.

In addition, according to the present invention, it is possible to provide an organic light emitting display device 10 that may increase the numerical aperture, lengthen a lifespan of light emitting diodes, and reduce the incidence probability of defects.

Accordingly, these features can be advantageous when applied to a high resolution and large area panel 11.

While the technical spirit of the present invention has been exemplarily described with reference to the accompanying drawings, it will be understood by a person skilled in the art that the present invention may be varied and modified in various forms without departing from the scope of the present invention. Accordingly, the embodiments disclosed in the present invention are merely to not limit but describe the technical spirit of the present invention. Further, the scope of the technical spirit of the present invention is not limited by the embodiments. The scope of the present invention shall be construed on the basis of the accompanying claims in such a manner that all of the technical ideas included within the scope equivalent to the claims belong to the present invention.

What is claimed is:

1. A display device comprising:

a plurality of data lines;

a plurality of gate lines intersecting with the plurality of data lines;

a plurality of pixels connected with the plurality of data lines and the plurality of gate lines; and a reference voltage line configured to supply a reference voltage to the pixels, wherein each of the plurality of pixels includes: a driving transistor configured to be controlled by a second transistor, a first transistor controlled by a first scan signal from the gate lines and connected between the reference voltage line and a first node of the driving transistor, and the second transistor controlled by a second scan signal supplied from the gate lines and connected between the data lines and a second node of the driving transistor, wherein each first transistor has a first electrode node and a second electrode node, wherein the first electrode nodes of the first transistors of two or more pixels are configured as a shared node electrically connected with the reference voltage line, and the second electrode nodes of the first transistors of said two or more pixels are configured as respective nodes separate from each other, and each of said respective nodes is connected with the first node of the driving transistor of a respective pixel directly or through a connection pattern, and wherein the first electrode nodes of the first transistors of said two or more pixels are formed integrally with the reference voltage line.

2. The display device of claim 1, wherein:

the reference voltage line is positioned in one direction to supply the reference voltage to a pixel connected with a $(4n-3)^{th}$ data line, a pixel connected with a $(4n-2)^{th}$ data line, a pixel connected with a $(4n-1)^{th}$ data line, and a pixel connected with a $(4n)^{th}$ data line, and the first electrode nodes of four first transistors of the pixel connected with the $(4n-3)^{th}$ data line, the pixel connected with the $(4n-2)^{th}$ data line, the pixel connected with the $(4n-1)^{th}$ data line, and the pixel connected with the $(4n)^{th}$ data line, respectively, are configured as said shared node formed integrally with the reference voltage line, and the second electrode nodes of said four first transistors are individually configured as said respective nodes, wherein the n is a natural number.

3. The display device of claim 2, wherein each of the respective nodes of the first transistors, which are respectively included in the pixel connected with the $(4n-2)^{th}$ data line and the pixel connected with the $(4n-1)^{th}$ data line, is connected with the first node of the driving transistor directly, and each of the respective nodes, which are respectively included in the pixel connected with the $(4n-3)^{th}$ data line and the pixel connected with the $(4n)^{th}$ data line, is connected with the first node of the driving transistor through the connection pattern.

4. The display device of claim 2, wherein the shared node has a shape obtained by combining two or more of a "|" shape, a "—" shape, a "┐" shape, a "└" shape, a "⊏" shape, and partially rounded shapes thereof.

5. The display device of claim 4, wherein the shared node has a "┼" shape, a "⊥" shape, a "E" shape, or a " 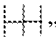 " shape.

6. The display device of claim 2, wherein a distance between the shared node and the respective node of at least one of the four first transistors is different from that of another one of the four first transistors.

7. The display device of claim 2, wherein a pixel structure of the pixel connected with the $(4n-3)^{th}$ data line and a pixel structure of the pixel connected with the $(4n)^{th}$ data line are symmetric to each other, and a pixel structure of the pixel connected with the $(4n-2)^{th}$ data line and a pixel structure of the pixel connected with the $(4n-1)^{th}$ data line are symmetric to each other.

8. The display device of claim 1, further comprising a display panel, wherein the display panel comprises:

a data driver configured to drive the plurality of data lines positioned in one direction;

a gate driver configured to supply the first scan signal and the second scan signal through the plurality of gate lines which are positioned in another direction intersecting with the data lines; and a timing controller configured to control a driving timing of the data driver and the gate driver.

9. The display device of claim 8, further comprising:

a sensor configured to sense a voltage of the first node of the driving transistor.

10. The display device of claim 9, wherein the sensor comprises:

an analog to digital converter configured to convert the sensed voltage into a digital value; and a first switch configured to perform switching such that one of a reference voltage supply node, to which a reference voltage is supplied, and a sensing node connected to the analog to digital converter is connected with the reference voltage line.

11. The display device of claim 9, wherein a plurality of sensors are provided, a number of the sensors corresponding to a number of the data lines or a number of reference voltage lines.

12. The display device of claim 8, wherein the timing controller controls switching operations of:

a first switch configured to perform switching between an ON position, in which the reference voltage line is connected with a reference voltage supply node, and an OFF position, in which the reference voltage line is connected with a sensing node, and a second switch configured to perform switching between an ON position, in which a data voltage output point of the data driver is connected with a corresponding data line, and an OFF position, in which the data line is disconnected from the data voltage output point and floating.

13. The display device of claim 9, further comprising:

a compensator configured to perform data conversion processing that compensates characteristic information of the driving transistor based on the sensed voltage; and a memory configured to store the sensed voltage or the characteristic information of the driving transistor.

14. The display device of claim 13, wherein the compensator is included within the timing controller.

15. The display device of claim 14, wherein, when the compensator is included within the timing controller, the compensator converts data supplied from outside into compensation data based on the characteristic information of the driving transistor, and supplies the compensation data to the data driver.

16. The display device of claim 1, further comprising:

a data driver configured to drive the plurality of data lines; and a timing controller configured to control a driving timing of the data driver, wherein the data driver is configured to supply a data voltage to the second node of the driving transistor of a selected pixel to sense a varied voltage at the first node of the driving transistor of the selected pixel.

17. The display device of claim 1, wherein a semiconductor layer or an active layer is positioned between the shared node and the respective nodes.

18. The display device of claim 17, wherein a gate node is positioned below the semiconductor layer or the active layer, and wherein the first transistor is controlled by a scan signal supplied to the gate node.

* * * * *